US005547825A

United States Patent [19]

Takahashi et al.

[11] Patent Number: 5,547,825

[45] Date of Patent: Aug. 20, 1996

[54] SILVER HALIDE COLOR PHOTOGRAPHIC MATERIAL

[75] Inventors: Osamu Takahashi; Nobutaka Ohki, both of Minami Ashigara, Japan

[73] Assignee: Fuji Photo Film Co., Ltd., Kanagawa, Japan

[21] Appl. No.: 428,585

[22] Filed: Apr. 25, 1995

Related U.S. Application Data

[63] Continuation of Ser. No. 70,702, Jun. 2, 1993, abandoned.

[30] Foreign Application Priority Data

Jun. 2, 1992 [JP] Japan ..... 4-165482

[51] Int. Cl.[6] ..... G03C 7/392; G03C 7/38

[52] U.S. Cl. ..... 430/551; 430/546; 430/558

[58] Field of Search ..... 430/551, 558, 430/546

[56] References Cited

U.S. PATENT DOCUMENTS

| | | | |
|---|---|---|---|
| 4,525,451 | 6/1985 | Ohki et al. | 430/551 |
| 4,584,264 | 4/1986 | Ohki et al. | 430/551 |
| 4,587,210 | 5/1986 | Ono et al. | 430/551 |
| 4,732,845 | 3/1988 | Keiji et al. | 430/551 |
| 5,021,328 | 6/1991 | Takahashi | 430/546 |
| 5,122,444 | 6/1992 | Sakai | 430/505 |
| 5,153,109 | 6/1992 | Abe et al. | 430/551 |
| 5,156,945 | 10/1992 | Matsumoto et al. | 430/551 |
| 5,164,289 | 11/1992 | Shimada et al. | 430/558 |
| 5,215,871 | 6/1993 | Sato et al. | 430/558 |
| 5,256,526 | 10/1993 | Suzuki et al. | 430/558 |

FOREIGN PATENT DOCUMENTS

| | | |
|---|---|---|
| 0342637A2 | 11/1989 | European Pat. Off. . |
| 0431329A2 | 6/1991 | European Pat. Off. . |
| 0484909A1 | 5/1992 | European Pat. Off. . |
| 0491197A1 | 6/1992 | European Pat. Off. . |
| 0488248A1 | 6/1992 | European Pat. Off. . |
| 63-226653 | 9/1988 | Japan . |
| 2135442 | 5/1990 | Japan . |
| 2136855 | 5/1990 | Japan . |
| 361946 | 3/1991 | Japan . |

*Primary Examiner*—Lee C. Wright

*Attorney, Agent, or Firm*—Birch, Stewart, Kolasch & Birch, LLP

[57] ABSTRACT

A silver halide color photographic material which has on a support the combination of a pyrroloazole type cyan coupler and a redox compound having a molecular weight of at least 350 to provide color photographs having faithfully reproduced colors which are highly fast to light under both high and low humidity conditions.

17 Claims, No Drawings

SILVER HALIDE COLOR PHOTOGRAPHIC MATERIAL

This application is a continuation of application Ser. No. 08/070,702 filed on Jun. 2, 1993, now abandoned.

FIELD OF THE INVENTION

The present invention relates to a color photographic material and, more particularly, to a color photographic material which can provide color photographs wherein the color reproduction performed is highly satisfactory and the dyes formed have high stability.

BACKGROUND OF THE INVENTION

Photosensitive materials, such as color photographic paper and the like, are generally provided with emulsion layers which comprise silver halide emulsions sensitive to rays of light in blue, green and red wavelength regions respectively, and therein are formed color images by incorporating into said emulsion layers so-called color couplers which can form their individual dyes by undergoing the coupling reaction with the oxidized developing agent which is produced upon development of the optically exposed silver halide emulsions. (In the incorporation of color couplers, each coupler is generally combined with the emulsion layer whose photosensitivity is in the wavelength region the color of which bears a complementary-color relationship to the dye formed from said color coupler.) As for the dye-forming couplers, pivaloylacetoanilides are examples of yellow dye-forming couplers, 5-pyrazolones and pyrazoloazoles are those of magenta dye-forming couplers, and phenols and naphthols are those of cyan dye-forming couplers.

Of these dye-forming couplers, phenols or naphthols which have so far been used as a cyan dye-forming coupler have drawbacks such that the dyes formed therefrom absorb light in the green region also because the main absorption curve they have in the red region, by which they can assume the hue of cyan, is broad on the shorter wavelength side, the dyes formed therefrom have a side absorption in the blue region in addition to the main absorption, and so on.

With the intention of removing drawbacks as described above, there have been proposed various couplers, for instance, the imidazole type couplers disclosed in JP-A-63-226653 (the term "JP-A" as used herein means an "unexamined published Japanese patent application"), JP-A-03-61946, etc., the couplers having a structure formed by condensing a pyrazole ring and a nitrogen-containing 6-membered ring, which are disclosed in JP-A-02-135442, JP-A-02-136855, etc., and so on. However, they are not wholly satisfactory in view of the hue of developed colors, the color formability and the fastness of dye images.

For color prints in particular, though it goes without saying that the hue just after processing is important, it is also important to retain said hue forever (e.g., upon long-range storage). Under these circumstances, it has been sought the art to obtain cyan dyes which not only have excellent hue but also ensure excellent dye image stability even when stored under inferior conditions, e.g., under high humidity, exposure to light, or the like.

SUMMARY OF THE INVENTION

Therefore, an object of the present invention is to provide a color photosensitive material which has excellent color reproducibility and ensures color photographs having highly-fast color images even under a condition of high humidity.

As a result of our intensive studies, it has been found that the foregoing object can be attained effectively with a silver halide color photographic material which has on a support at least one cyan coupler represented by the following general formula (Ia) and at least one compound having a molecular weight of at least 350 which is selected from compounds represented by the following general formula [A], compounds represented by the following general formula [B] or compounds of the following general formula [C]:

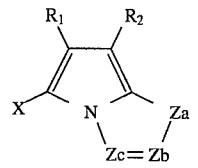

(Ia)

wherein Za represents —NH— or —CH($R_3$)—; Zb and Zc each represent —C($R_4$)= or —N=; $R_1$, $R_2$ and $R_3$ each represent an electron-withdrawing group having a Hammett's substituent constant $\sigma_p$ of at least 0.2, provided that the sum of the op values of $R_1$ and $R_2$ is at least 0.65; $R_4$ represents a hydrogen atom or a substituent group, and when two $R_4$'s are present in the formula they may be the same or different; and X represents a hydrogen atom or a group capable of splitting off by the coupling reaction with the oxidization product of an aromatic primary amine color developing agent; or $R_1$, $R_2$, $R_3$, $R_4$ or X may be a divalent group by way of which the cyan coupler can form a dimer or higher polymer or combine with a high molecular chain to form a homo- or copolymer:

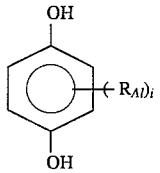

[A]

wherein $R_{A1}$ represents a monovalent group; and i represents an integer of 1 to 4, and the $R_{A1}$'s (in the case of i=2 to 4) may be the same or different:

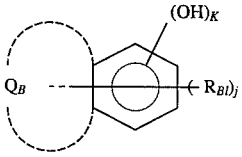

[B]

wherein $R_{B1}$ represents a monovalent group; j represents an integer of 1 to 6, and $R_{B1}$'s, in the case of j=2 to 6, may be the same or different; k represents 2 or 3, and two —OH groups, in the case of k=2, are situated in a position wherein they are ortho or meta to each other, while three —OH groups, in the case of k=3, are situated in a position adjacent to one another; ---$Q_B$--- represents that a naphthalene ring may form together with the benzene ring:

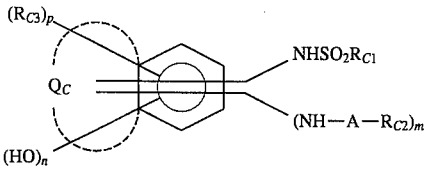

[C]

wherein A represents —CO— or —$SO_2$—; $R_{C1}$ and $R_{C2}$ each represent an alkyl group, an aryl group, a heterocyclyl group or an amino group; $R_{C3}$ represents a monovalent group; m represents an integer of 0 to 2, and the two (—NH—A—$R_{C2}$)'s, in the case of m=2, may be the same or different; n represents an integer of 0 to 2, provided that the sum of m and n is 1 or 2; at least either the moiety —NH—A—$R_{C2}$ or —OH group is situated in the position ortho or para to —$NHSO_2R_{C1}$; p represents an integer of 0 to 6, and $R_{C3}$'s, in the case of p=2 to 6, may be the same or different; ---$Q_C$--- represents that a naphthalene ring may form together with the benzene ring.

DETAILED DESCRIPTION OF THE INVENTION

Compounds used in the present invention are described below in detail.

The present cyan couplers of general formula (Ia) specifically include those represented by the following general formulae (IIa) to (VIIIa):

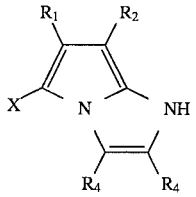

(IIa)

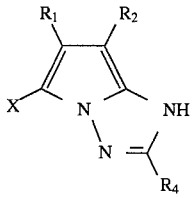

(IIIa)

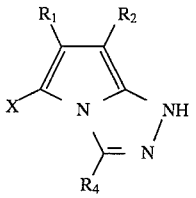

(IVa)

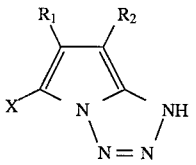

(Va)

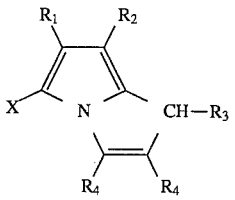

(VIa)

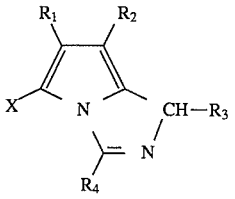

(VIIa)

-continued

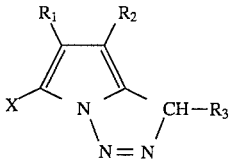

(VIIIa)

wherein $R_1$, $R_2$, $R_3$, $R_4$ and X have the same meanings as in general formula (Ia), respectively.

The cyan couplers which are preferable in the present invention are those represented by general formulae (IIa), (IIIa) and (IVa), especially those represented by general formula (IIIa).

In the cyan couplers of the present invention, the substituents $R_1$, $R_2$ and $R_3$ all are electron-withdrawing groups having a Hammett's $\sigma_p$ value of at least 0.20, and the sum of the $\sigma_p$ value of $R_1$ and that of $R_2$ is at least 0.65. As for the $\sigma_p$ values of $R_1$ and $R_2$, the sum thereof is preferably at least 0.70, and the upper limit of the sum is around 1.8.

$R_1$, $R_2$ and $R_3$ are each an electron-withdrawing group having a Hammett's substituent constant, or a Hammett's $\sigma_p$ value, of at least 0.2, preferably at least 0.35, and much preferably at least 0.60. With respect to the $\sigma_p$ value, the electron-withdrawing group has an upper limit of no greater than 1.0. The Hammett's rule is the empirical rule proposed by L. P. Hammett in 1935 in order to treat quantitatively the effects of substituent groups upon the reaction or the equilibrium of benzene derivatives, and its validity is universally appreciated in these times. The substituent constants determined by the Hammett's rule are $\sigma_p$ and $\sigma_m$ values. We can find the description of these values in many general books. For instance, there are detailed descriptions in J. A. Dean, *Lange's Handbook of Chemistry*, 12th edition, McGraw-Hill (1979), and *Kagaku no Ryo-iki Zokan* (which means special numbers of "Domain of Chemistry"), number 122, pages 96 to 103, Nankodo, Tokyo (1979). In the present invention, $R_1$, $R_2$ and $R_3$ are specified definitely using a Hammett's substituent constant $\sigma_p$. Additionally, these substituents should not be construed as being limited to the substituents whose $\sigma_p$ values are already known through the references adopted in the above-cited books, but it is a matter of course that they include any substituents whose $\sigma_p$ values are within the range defined by the present invention when determined by the Hammett's rule even if they are not yet reported in literature.

Specific examples of electron-withdrawing groups having a $\sigma_p$ value of at least 0.20, which are represented by $R_1$, $R_2$ and $R_3$, include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenoalkyl group, a halogenoalkoxy group, a halogenoaryloxy group, a halogenoalkylamino group, a halogenoalkylthio group, an aryl group substituted with other electron-withdrawing groups having a $\sigma_p$ value of at least 0.20, a heterocyclyl group, a halogen atom, an azo group, and a selenocyanate group. These groups may further have substituents such as examples of the group represented by $R_4$ described hereinafter, provided that they can afford room for substituent groups.

More specifically describing $R_1$, $R_2$ and $R_3$, the electron-withdrawing groups whose $\sigma_p$ values are at least 0.20 include an acyl group (e.g., acetyl, 3-phenylpropanoyl, benzoyl, 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, N-{3-(2,4-di-tert-amylphenoxy)propyl}carbamoyl), an alkoxycarbonyl group (e.g., methoxycarbonyl, ethoxycarbonyl, isopropyloxycarbonyl, tert-butyloxycarbonyl, isobutyloxycarbonyl, butyloxycarbonyl, dodecyloxycarbonyl, octadecyloxycarbonyl, diethylcarbamoylethoxycarbonyl, perfluorohexylethoxycarbonyl, 2-decyl-hexyloxycarbonylmethoxycarbonyl), an aryloxycarbonyl group (e.g., phenoxycarbonyl, 2,5-diamylphenoxycarbonyl), a cyano group, a nitro group, a dialkylphosphono group (e.g., dimethylphosphono), a diarylphosphono group (e.g., diphenylphosphono), a dialkoxyphosphoryl group (e.g., dimethoxyphos-phoryl), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluenesulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulffamoyl, N-(2-dodecyloxyethyl)sulfamoyl, N-ethyl-N-dodecylsulfamoyl, N,N-diethylsulfamoyl), a thiocyanate group, a thiocarbonyl group (e.g., methylthiocarbonyl, phenylthiocarbonyl), a halogenoalkyl group (e.g., trifluoromethyl, heptafluoropropyl), a halogenoalkoxy group (e.g., trifluoromethoxy), a halogenoaryloxy group (e.g., pentafluorophenoxy), a halogenoalkylamino group (e.g., N,N-di-(trifluoromethyl)amino), a halogenoalkylthio group (e.g., difluoromethylthio, 1,1,2,2-tetrafluoroethylthio), an aryl group substituted with other electron-withdrawing groups having a $\sigma_p$ value of at least 0.20 (e.g., 2,4-dinitrophenyl, 2,4,6-trichlorophenyl, pentachlorophenyl), a heterocyclyl group (e.g., 2-benzoxazolyl, 2-benzothiazolyl, 1-phenyl-2-benzimidazolyl, pyrazolyl, 5-chloro-1-tetrazolyl, 1-pyrrolyl), a halogen atom (e.g., chlorine, bromine), an azo group (e.g., phenylazo) and a selenocyanate group.

As for the representative electron-withdrawing groups, their $\sigma_p$ values are given below in parenthesis after the corresponding groups: cyano group (0.66), nitro group (0.78), trifluoromethyl group (0.54), acetyl group (0.50), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), pyrazolyl group (0.37), methanesulfonyloxy group (0.36), dimethoxyphosphoryl group (0.60), sulfamoyl group (0.57), and so on.

Substituent groups desirable for $R_1$, $R_2$ and $R_3$ include an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenoalkyl group, a halogenoalkoxy group, a halogenoalkylthio group, a halogenoaryloxy group, a halogenoaryl group, an aryl group substituted with at least two nitro groups, and a heterocyclyl group. Of these groups, preferable ones are an acyl group, an alkoxycarbonyl group, an aryloxycarbonyl group, a nitro group, a cyano group, an arylsulfonyl group, a carbamoyl group and a halogenoalkyl group. Much preferable ones are a cyano group, an alkoxycarbonyl group, an aryloxycarbonyl group and a halogenoalkyl group.

Particularly preferred are a cyano group, a trifluromethyl group, a straight-chain or branched unsubstituted alkoxycarbonyl group, an alkoxycarbonyl group substituted with a carbomoyl group, an alkoxycarbonyl group having an ether bond, or an aryloxycarbonyl group that is either unsubstituted or substituted with an alkyl group or an alkoxy group.

The combination of $R_1$ and $R_2$ is preferably that $R_1$ is a cyano group and $R_2$ is any of a trifluoromethyl group, a straight-chain or branched unsubstituted alkoxycarbonyl group, an alkoxycarbonyl group substituted with a carbamoyl group, an alkoxycarbonyl group having an ether bond, and an aryloxycarbonyl group that is either unsubstituted or substituted with an alkyl group or an alkoxy group.

$R_4$ represents a hydrogen atom or a substituent group (including an atom). Specific examples of the substituent group include a halogen atom, an aliphatic group, an aryl group, a heterocyclic group, an alkoxy group, an aryloxy group, a heterocyclic oxy group, an alkyl-, aryl- or heterocyclic thio group, an acyloxy group, a carbamoyloxy group, a silyloxy group, a sulfonyloxy group, an acylamino group, an alkylamino group, an arylamino group, an ureido group, a sulfamoylamino group, an alkenyloxy group, a formyl group, an alkyl-, aryl- or heterocyclic acyl group, an alkyl-, aryl or heterocyclic sulfonyl group, an alkyl-, aryl- or heterocyclic sulfinyl group, an alkyl-, aryl- or heterocyclic oxycarbonyl group, an alkyl-, aryl- or heterocyclic oxycarbonylamino group, a sulfonamido group, a carbamoyl group, a sulfamoyl group, a phosphonyl group, a sulfamido group, an imido group, an azolyl group, a hydroxy group, a cyano group, a carboxyl group, a nitro group, a sulfo group and an unsubstituted amino group. The alkyl, aryl or heterocyclic moieties contained in the above-cited groups may further be substituted with the substituent group(s) exemplified for $R_4$.

More specifically, $R_4$ represents a hydrogen atom, a halogen atom (e.g., chlorine, bromine), an aliphatic group (including straight-chain or branched alkyl, aralkyl, alkenyl, alkinyl, cycloalkyl and cycloalkenyl groups which each contain 1 to 36 carbon atoms, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecanamido}phenyl)propyl, 2-ethoxytridecyl, trifluoromethyl, cyclopentyl, 3-(2,4-di-t-amylphenoxy)propyl), an aryl group (preferably containing 6 to 36 carbon atoms, e.g., phenyl, naphthyl, 4-hexadecyloxyphenyl, 4-t-butylphenyl, 2,4-di-t-amylphenyl, 4-tetradecanamidophenyl, 3-(2,4-di-tert-amylphenoxyacetamido)phenyl), a heterocyclic group (e.g., 3-pyridyl, 2-furyl, 2-thienyl, 2-pyridyl, 2-pyrimidinyl, 2-benzothiazolyl), an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, 3-methoxycarbamoylphenoxy), a heterocyclic oxy group (e.g., 2-benzimidazolyloxy, 1-phenyltetrazole-5-oxy, 2-tetrahydropyranyloxy), an alkyl-, aryl- or heterocyclic thio group (e.g., methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetradecanamidophenylthio, 2-benzothiazolylthio, 2,4-di-phenoxy-1,3,5-triazole-6-thio, 2-pyridylthio), an acyloxy group (e.g., acetoxy, hexadecanoyloxy ), a carbamoyloxy group (e.g., N-ethylcarbamoyloxy, N-phenylcarbamoyloxy), a silyloxy group (e.g., trimethylsilyloxy, dibutylmethylsilyloxy), a sulfonyloxy group (e.g., dodecylsulfonyloxy ), an acylamino group (e.g., acetamido, benzamide, tetradecanamido, 2-(2,4-di-tert-amylphenoxyacetamido, 2-[4-{4-hydroxyphenylsulfonyl}phenoxy]decanamido, isopentadecanamido, 2-(2,4-di-t-amylphenoxy)butanamido, 4-(3-t-butyl-4-hydroxyphenoxy)butanamido), an alkylamino group (e.g., methylamino, butylamino, dodecylamino, dimethylamino, diethylamino, methylbutylamino), an arylamino group (e.g., phenylamino, 2-chloroanilino, 2-chloro-5-tetradecanamidoanilino, N-acetylanilino, 2-chloro-5-[α-(2-tert-butyl-4-hydroxypnehoxy)dodecanamido]anilino, 2-chloro- 5-dodecyloxycarbonylanilino), an ureido group (e.g., methylureido, phenylureido, N,N-dibutylureido, dimethylureido), a sulfamoylamino group (e.g., N,N-dipropylsulfamoylamino, N-methyl-N-decylsulfamoylamino), an alkenyloxy group (e.g., 2-propenyloxy), a formyl group, an alkyl-, aryl- or heterocyclic acyl group (e.g., acetyl, benzoyl, 2,4-di-tert-amylphenylacetyl, 3-phenylpropanoyl, 4-dodecyloxybenzoyl), an alkyl-, aryl- or heterocyclic sulfonyl group (e.g., methanesulfonyl, octanesulfonyl, benzenesulfonyl, toluenesulfonyl), an alkyl-, aryl- or heterocyclic sulfinyl group (e.g., octanesulfinyl, dodecylsulfinyl, dodecanesulfinyl, phenylsulfinyl, 3-pentadecylphenylsulfinyl, 3-phenylsulfinyl), an alkyl-, aryl- or heterocyclic oxycarbonyl group (e.g., methoxycarbonyl, butoxycarbonyl, dodecyloxycarbonyl, octadecyloxycarbonyl, phenoxycarbonyl, 2-pentadecyloxycarbonyl), an alkyl-, aryl- or heterocyclic oxycarbonylamino group (e.g., methoxycarbonylamino, tetradecyloxycarbonylamino, phenoxycarbonylamino, 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, 2-methoxy-5-tert-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-[3-(2,4-di-tert-amylphenoxy)propyl]carbamoyl), a sulfamoyl group (e.g., N-ethylsulfamoyl, N,N-dipropylsulfamoyl, N-(2-dodecyloxyethyl-)sulfamoyl, N-ethyl-N-dodecylsulfamoyl, N,N-diethylsulfamoyl), a phosphonyl group (e.g., phenoxyphosphonyl, octyloxyphosphonyl, phenylphosphonyl), a sulfamido group (e.g., dipropylsulfamoylamino), an imido group (e.g., N-succinimido, hydantoinyl, N-phthalimido, 3-octadecenylsuccinimido), an azolyl group (e.g., imidazolyl, pyrazolyl, 3-chloropyrazole-1-yl, triazolyl), a hydroxyl group, a cyano group, a carboxyl group, a nitro group, a sulfo group, an unsubstituted amino group, or the like.

Groups preferred as $R_4$ are an alkyl group, an aryl group, a heterocyclyl group, a cyano group, a nitro group, an acylamino group, an arylamino group, an ureido group, a sulfamoylamino group, an alkylthio group, an arylthio group, a heterocyclylthio group, an alkoxycarbonylamino group, an aryloxycarbonylamino group, a sulfonamido group, a carbamoyl group, a sulfamoyl group, a sulfonyl group, an alkoxycarbonyl group, an aryloxycarbonyl group, a heterocyclyloxy group, an acyloxy group, a carbamoyloxy group, an imido group, a sulfinyl group, a phosphonyl group, an acyl group and an azolyl group.

Of these groups, an alkyl group and an aryl group are much preferable. Further, it is desirable for these groups to be substituted with at least one alkoxy, sulfonyl, sulfamoyl, carbamoyl, acylamido or sulfonamido group. An especially preferred group as $R_4$ is an alkyl or aryl group containing at least one acylamido or sulfamido group as a substituent.

X in general formula (Ia) represents a hydrogen atom or a group capable of splitting off when the coupler reacts with the oxidation product of an aromatic primary amine color developing agent (the group is abbreviated as "a splitting-off group"). When X represents a splitting-off group, the splitting-off group includes a halogen atom; an aromatic azo group; an alkyl, aryl, heterocyclic, alkyl- or arylsulfonyl, arylsulfinyl, alkoxy-, aryloxy- or heterocyclic oxycarbonyl, alkyl-, aryl- or heterocyclic carbonyl, or alkyl-, aryl- or heterocyclic aminocarbonyl group, which is attached to the coupling active site via an oxygen, nitrogen, sulfur or carbon atom; and a heterocyclyl group which is attached to the coupling active site via the nitrogen atom thereof. Specifically, a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoylamino group, an arylsulfinyl group, an arylsulfonyl group, a 5- or 6-membered nitrogen-containing heterocyclyl group, an imido group and an arylazo group are examples of the splitting-off group. The alkyl, aryl or heterocyclic moiety contained in the above-cited groups may further be substituted with group(s) included in specific examples of $R_4$. When such a moiety has two or more substituents, the substituents may be the same or different and may further have such a substituent as instanced in the description of $R_4$.

More specifically, the splitting-off group includes halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonamido, trifluoromethanesulfonamido, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an alkyl-, aryl or heretocyclic thio group (e.g., ethylthio, 2-carboxyethylthio, dodecylthio, 1-carboxydodecylthio, phenylthio, 2-butoxy-5-t-octylphenylthio, tetrazolylthio), an arylsulfonyl group (e.g., 2-butoxy-5-tert-octylphenylsulfonyl), an arylsulfinyl group (e.g., 2-butoxy-5-tert-octylphenylsulfinyl), a carbamoylamino group (e.g., N-methylcarbamoylamino, N-phenylcarbamoylamino), a 5- or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl), an arylazo group (e.g., phenylazo, 4-methoxyphenylazo) and so on. Of course, these groups may further be substituted with substituent(s) instanced in the description of $R_4$. In addition, splitting-off groups of the type which are attached to the coupling site via a carbon atom include those which constitute his-type couplers formed by condensing four-equivalent couplers through aldehydes or ketones. The splitting-off groups used in the present invention may contain a photographically useful group, such as a development inhibitor residue, a development accelerator residue, or the like.

It is preferable for X to be a halogen atom, an alkoxy group, an aryloxy group, an alkyl- or arylthio group, an arylsulfonyl group, an arylsulfinyl group or a 5- or 6-membered nitrogen-containing heterocyclyl group which is attached to the coupling active site via the nitrogen thereof. Of the above-cited groups, an arylthio group is much preferable.

The cyan coupler represented by general formula (Ia) may be a dimer or higher polymer formed from one or more residues of the cyan coupler of general formula (Ia) in the substituent group $R_1$, $R_2$, $R_3$, $R_4$ or X, or may be a homo- or copolymer containing a high molecular chain in the substituent group $R_1$, $R_2$, $R_3$, $R_4$ or X. The expression "a homo- or copolymer containing a high molecular chain" as used herein is intended to include, as typical examples, polymers consisting of or comprising addition-polymerizable ethylenic unsaturated compounds containing a residue of the cyan coupler represented by general formula (Ia). Herein, the cyan color-forming repeating units present in a polymer molecule may, if desired, not be the same, provided that they are a residue of the cyan coupler represented by general formula (Ia). As for the copolymer, the copolymerizing component thereof may be constituted of identical or different ethylenic monomers which cannot form color because they cannot couple with the oxidation product of an aromatic primary amine developer, such as acrylic acid esters, methacrylic acid esters and maleic acid esters.

Specific examples of the cyan coupler of the present invention are illustrated below. However, the invention should not be construed as being limited to these examples.

(1)
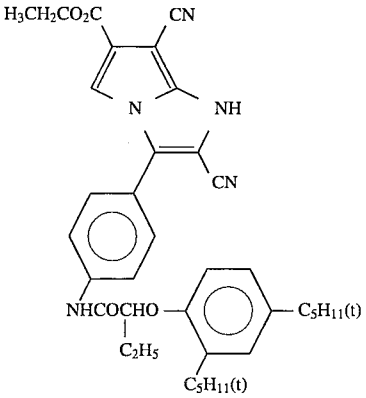
(2)
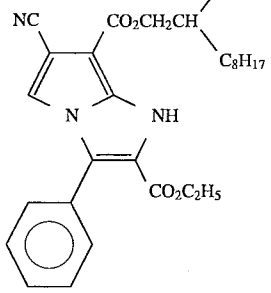

-continued
(3)
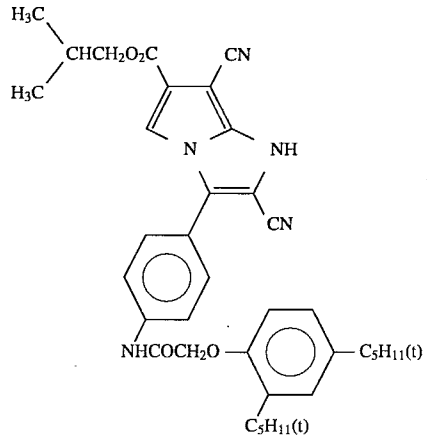
(4)
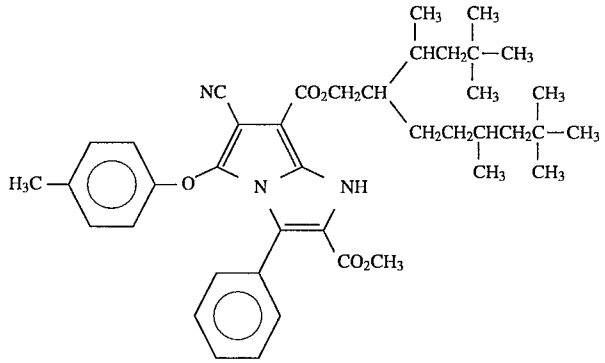

-continued
(5)
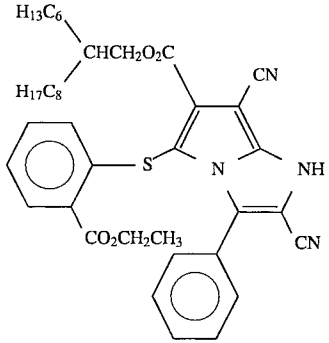
(6)
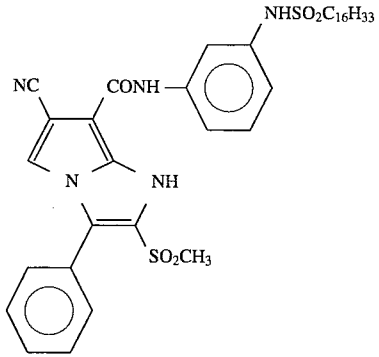
(7)
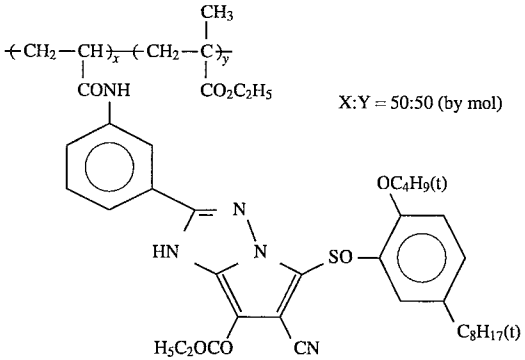

-continued
| No. | $R_1$ | $R_2$ | $R_4$ | X |
|---|---|---|---|---|
| | | 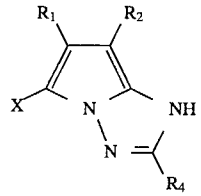 | | |
| 8 | $CO_2CH_3$ | CN | 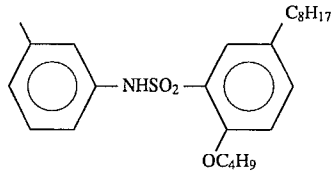 | H |
| 9 | CN | 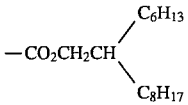 | 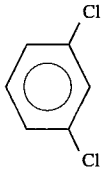 | H |
| 10 | CN | 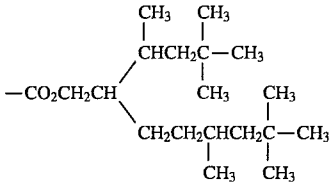 | 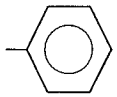 | H |
| 11 | CN | 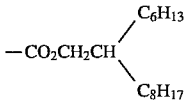 | 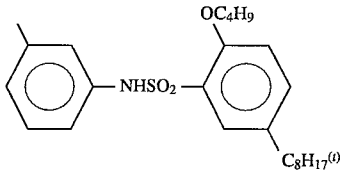 | H |

-continued
| | | | | |
|---|---|---|---|---|
| 12 | CN | 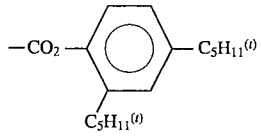 | 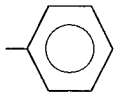 | H |
| 13 | CN | 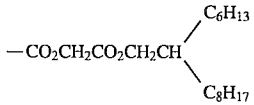 | 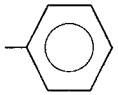 | H |
| 14 | CN | $-CO_2CH_2CH_2(CF_2)_6F$ | 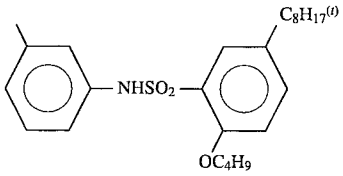 | H |
| 15 | CN | 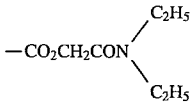 | 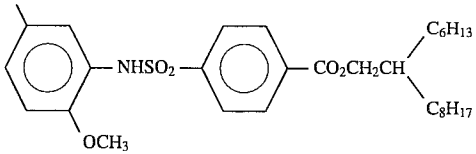 | 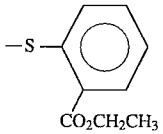 |
| 16 | CN | $-CO_2CH_2CH_2(CF_2)_6F$ | 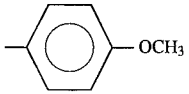 | 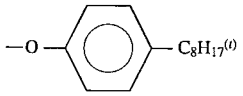 |
| 17 | CN | 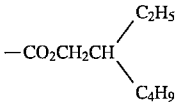 | 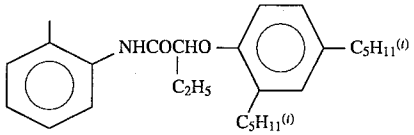 | 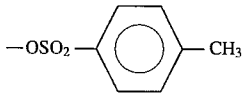 |
| 18 | CN | 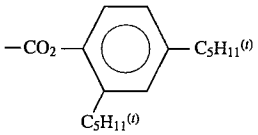 | 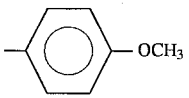 | 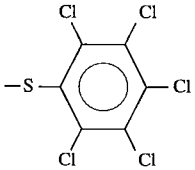 |

-continued
| | | | | |
|---|---|---|---|---|
| 19 | CN | $-CO_2CH_2CH(CH_3)_2$ | $-NHCONH-C_6H_3(NHSO_2C_{16}H_{33})(Cl)$ | 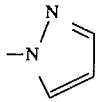 |
| 20 | CN | $-CO_2CH_2(CF_2)_4H$ | $-NHCOCH(C_6H_{13})O-C_6H_3(C_5H_{11}^{(t)})(C_5H_{11}^{(t)})$ | $-S(=O)-C_6H_3(C_8H_{17})(OC_4H_9)$ |
| 21 | CN | $-CO_2CH_2CH(C_8H_{17})(C_6H_{13})$ | $-C_6H_4-NHSO_2-C_6H_3(OC_4H_9)(C_8H_{17}^{(t)})$ | H |
| 22 | $-CO_2-C_6H_3(C_8H_{17}^{(t)})(C_8H_{17}^{(t)})$ | CN | $-C(CH_3)_3$ | $-O-C_6H_4-CO_2CH_2CH_3$ |
| 23 | $-CO_2CH_2C_6F_{13}$ | CN | $-C_6H_4-NHCOCH_2O-C_6H_3(C_5H_{11}^{(t)})(C_5H_{11}^{(t)})$ | Cl |
| 24 | $-SO_2-C_6H_5$ | $-CO_2CH_2CH(CH_2CH_2C(CH_3)_2CH_3)(CH_2CH_2CH(CH_3)CH_2C(CH_3)_2CH_3)$ | $CH_3$ | $-OCOCH_3$ |

-continued
| | | | | |
|---|---|---|---|---|
| 25 | CN | $-CO_2CH_2CO_2CH_3$ | 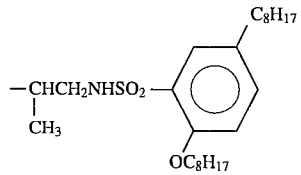 | 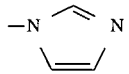 |
| 26 | CN | 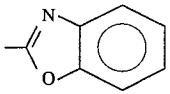 | 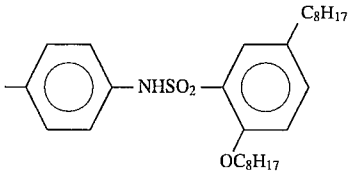 | 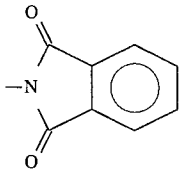 |
| 27 | CN | $CF_3$ | 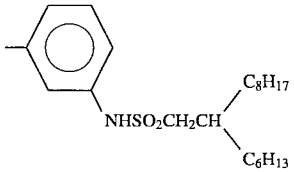 | Cl |
| 28 | 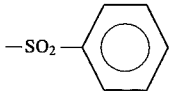 | $CF_3$ | 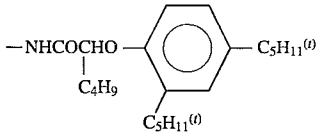 | F |
| 29 | CN | 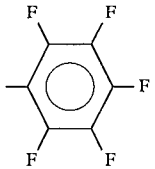 | 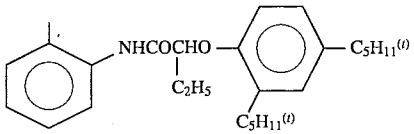 | 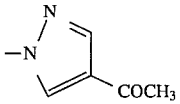 |
| 30 | 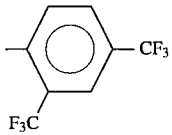 | 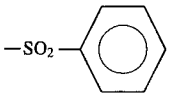 | 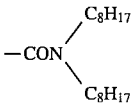 | 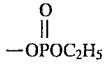 |

-continued
| | | | | |
|---|---|---|---|---|
| 31 | CN | 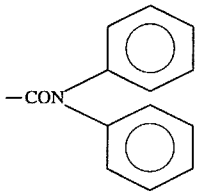 | 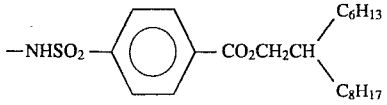 | 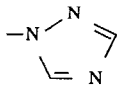 |
| 32 | CN | 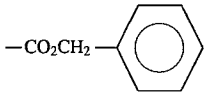 | 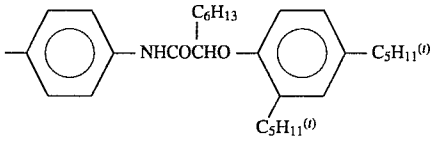 | H |
| 33 | CN | 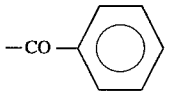 | 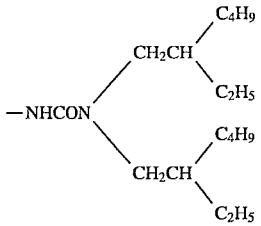 | $-OSO_2CH_3$ |
| | | 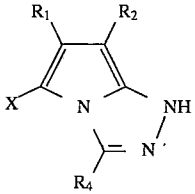 | | |
| 34 | $-CO_2C_2H_5$ | CN | 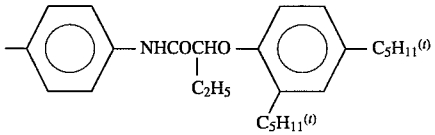 | Cl |
| 35 | CN | 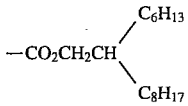 | 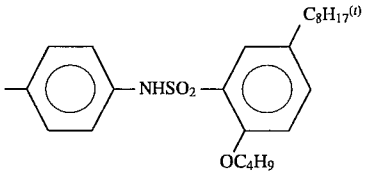 | H |

-continued
| | | | | |
|---|---|---|---|---|
| 36 | CN | $-CO_2CH_2CH_2(CF_2)_6F$ | $-CH_2CH_2CH_2-$ 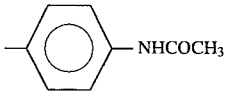 $-NHCOCH_3$ | 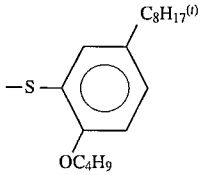 |
| 37 | CN | 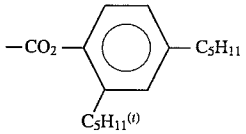 | 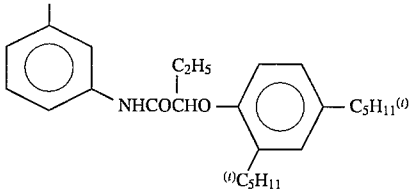 | 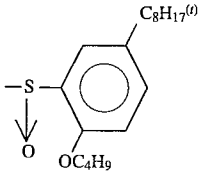 |
| 38 | CN | 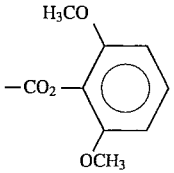 | $-CH_2\overset{CH_3}{\overset{\vert}{C}}HSO_2C_{16}H_{33}(i)$ | 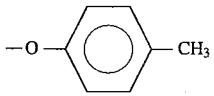 |
| 39 | CN | 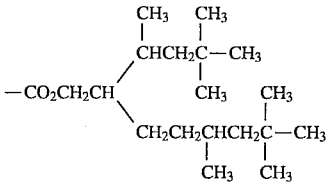 | 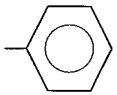 | H |
| 40 | CN | 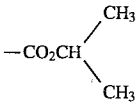 | 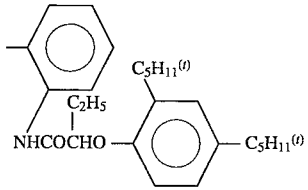 | Cl |
| 41 | CN | 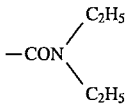 | 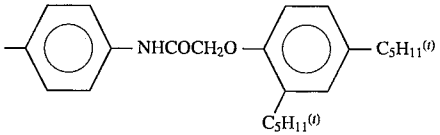 | $-OSO_2CH_3$ |

-continued
(42)
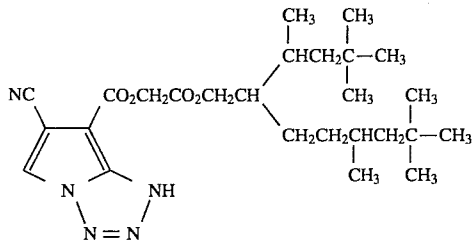
(43)
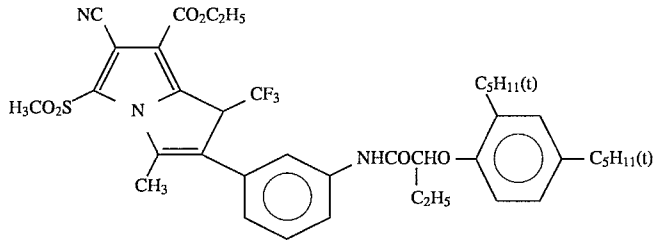
(44)
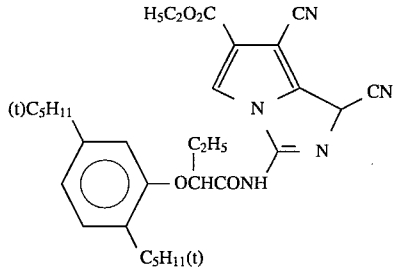
(45)
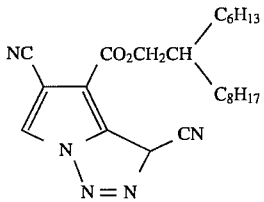

-continued
(46)
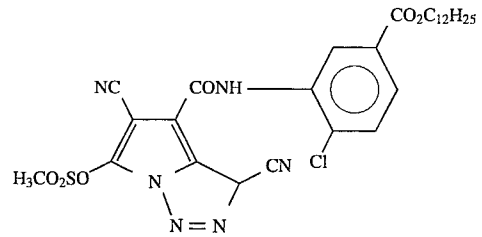

The present cyan couplers and intermediates thereof can be synthesized using known methods. Specifically, they can be synthesized according to the methods described, e.g., in *J. Am. Chem. Soc.*, 80, 5332 (1958), *J. Am. Chem. Soc.*, vol. 81, 2452 (1959), *J. Am. Chem. Soc.*, 112, 2465 (1990), *Org. Synth.*, 1270 (1941), *J. Chem. Soc.*, 5149 (1962), *Heterocycles.*, vol. 27, 2301 (1988), *Rec. Trav. Chim.*, 80, 1075 (1961), and references cited therein; or methods analogous thereto.

The synthesis of the present cyan couplers illustrated below with a concrete example.

Synthesis of Compound (9):

Compound (9) was synthesized in accordance with the following reaction scheme:

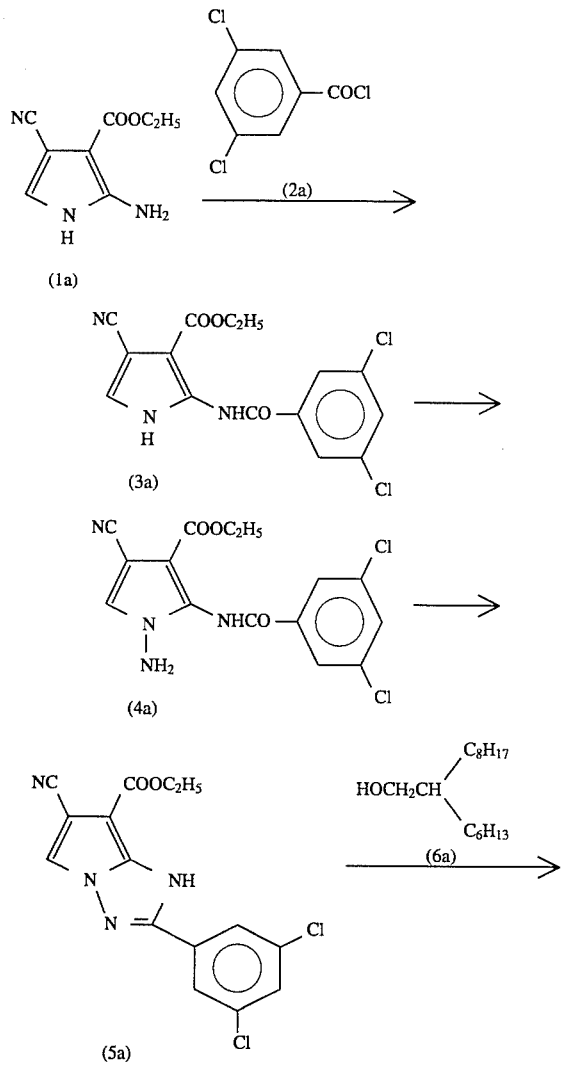

-continued

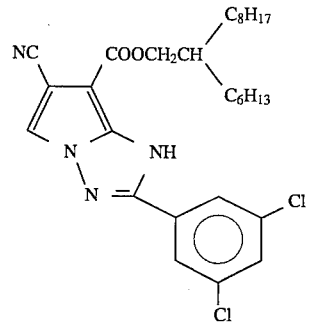

Compound (9)

To a solution containing 2-amino-4-cyano-3-ethoxycarbonylpyrrole (1a) (66.0 g, 0.4 mol) in dimethylacetamide (300 ml) was added 3,5-dichlorobenzoyl chloride (2a) (83.2 g, 0.4 mol) at room temperature. The mixture was stirred for 30 minutes, and then admixed with water. The resulting solution was extracted in two steps with ethyl acetate. The organic layers were collected, washed successively with water and saturated brine, and dried over anhydrous sodium sulfate. The solvent was distilled away therefrom, and the residue was recrystallized from acetonitrile (300 ml). Thus, Compound (3a) (113 g, 84% yield) was obtained.

Potassium hydroxide powder (252 g, 4.5 mol) was added to a solution containing Compound (3a) (101.1 g, 0.3 mol) in dimethylformamide (200 ml) at room temperature, and stirred thoroughly. The resulting solution was cooled in an ice bath, and thereto was added hydroxylamine-o-sulfonic acid (237 g, 2.1 mol) in limited amounts with caution so as not to steeply raise the temperature of the reaction system. After the addition was completed, the reaction mixture was stirred for 30 minutes. Then, it was neutralized by dropping thereinto a 0.1N aqueous solution of hydrochloric acid as the pH thereof was checked with test paper. The neutralized matter was extracted in three steps with ethyl acetate. The organic layer was washed successively with water and saturated brine, and dried over anhydrous sodium sulfate. The solvent was distilled away under reduced pressure, and the residue was purified by column chromatography (developer: hexane/ethyl acetate=2/1). Thus, Compound (4a) (9.50 g, 9% yield) was obtained.

To a solution containing Compound (4a) (7.04 g, 20 mmol) in acetonitrile (30 ml ), carbon tetrachloride (9 ml) first, and then triphenylphosphine (5.76 g, 22 mmol) were added at room temperature. The resulting mixture was heated for 8 hours under reflux. After cooling, it was admixed with water, and extracted in three steps with ethyl acetate. The organic layer was washed successively with water and saturated brine, and dried over anhydrous sodium sulfate. The solvent was distilled away under reduced pressure, and the residue was purified by silica gel column chromatography (developer: hexane/ethyl acetate=4/1). Thus, Compound (5a) (1.13 g, 17% yield) was obtained.

In 2.0 ml of sulforan were dissolved 1.8 g of Compound (5a) and 12.4 g of Compound (6a), and the solution was admixed with 1.5 g of titanium isopropoxide. The reaction was run for 1.5 hours as temperature was maintained at 110°

C. Thereafter, the reaction mixture was admixed with ethyl acetate, and washed with water. The ethyl acetate layer was dried, and ethyl acetate was distilled away therefrom. The residue was purified by column chromatography. Thus, 1.6 g of the intended compound (9) was obtained. m.p. 97° to 98° C.

The present cyan couplers represented by general formula (Ia) can be used in a silver halide color photographic material if only the photographic material has at least one layer in which the present couplers can be incorporated. Any layer may serve as the layer containing the present couplers as far as it is a hydrophilic colloid layer provided on a support. A general color photographic material can be constructed by providing on a support at least one blue-sensitive silver halide emulsion layer, at least one green-sensitive silver halide emulsion layer and at least one red-sensitive silver halide emulsion layer, in this order. However, arrangement orders other than the above-described one may be adopted. Also, an infrared-sensitive silver halide emulsion layer can be used in place of at least one among the foregoing light-sensitive emulsion layers. Therein, color reproduction can be effected in accordance with the subtractive color process by incorporating into each of those sensitive emulsion layers the combination of a silver halide emulsion having sensitivity in its individual wavelength region and a so-called color coupler which can form a dye bearing a complementary color relationship to the colored light by which the emulsion is sensitized. However, the photographic material of the present invention may be designed so as not to have the above-described correspondence of each light-sensitive layer to the developed hue of the coupler incorporated therein.

In using the present cyan couplers represented by general formula (Ia) for photographic materials, it is desirable in particular that they be incorporated into a red-sensitive silver halide emulsion layer.

The amount of the present couplers incorporated in a sensitive material ranges generally from $1\times10^{-3}$ to 1 mole, preferably from $2\times10^{-3}$ to $5\times10^{-1}$ mole, per mole of silver.

Additionally, the present cyan couplers may be used as a mixture of two or more thereof, and they may be used together with other cyan couplers as far as the effects of the present invention are not impaired.

In this case, other cyan couplers are used in a proportion of at most 50 mol %, preferably at most 30 mol %, to the present cyan couplers.

The compounds of general formula [A] are described below in detail.

In general formula [A], the monovalent group represented by $R_{A1}$ is, e.g., a halogen atom, an aliphatic group, an aromatic group, an alkylthio group, an arylthio group, a carbamoyl group, a cyano group, a formyl group, an aryloxy group, an alkoxy group, an acyloxy group, a carboxyl group or a salt thereof, a sulfo group or a salt thereof, an alkoxycarbonyl group, a cycloalkoxycarbonyl group, an aryloxycarbonyl group, —$COR_{A2}$, —$SO_2R_{A3}$, —$CONHR_{A4}$ or —$NHCOR_{A5}$, wherein $R_{A2}$, $R_{A3}$, $R_{A4}$ and $R_{A5}$ each represent an aliphatic group, an aromatic group or a heterocyclic group.

i represents an integer of 1 to 4, and when i is an integer of 2 to 4, the $R_{A1}$'s may be the same or different.

Representatives of the specific compounds represented by general formula [A] are shown in Table A.

TABLE A

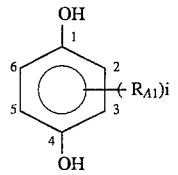

| Compound | $R_{A1}$ (substitution position(s)) | i |
|---|---|---|
| A-1 | (t)$C_{10}H_{21}$— (2,5) | 2 |
| A-2 | (t)$C_{12}H_{25}$— (2,5) | 2 |
| A-3 | (t)$C_{15}H_{31}$— (2,5) | 2 |
| A-4 | (t)$C_{18}H_{37}$— (2,5) | 2 |
| A-5 | (n)$C_{12}H_{25}$— (2,5) | 2 |
| A-6 | (sec)$C_{16}H_{33}$— (2,5) | 2 |
| A-7 | (sec)$C_{16}H_{33}$— (2), —$SO_3H$ (5) | 2 |
| A-8 | (n)$C_6H_{13}OC(=O)(CH_2)_3$—$C(CH_3)_2$— (2,5) | 2 |
| A-9 | (sec)$C_{14}H_{29}$— (2) | 1 |
| A-10 | (sec)$C_{12}H_{25}$— (2) | 1 |
| A-11 | (sec)$C_{18}H_{37}$— (2), $CH_3$— (5) | 2 |
| A-12 | (t)$C_{15}H_{31}$— (2), (t)$C_4H_9$— (5) | 2 |
| A-13 | (sec)$C_{18}H_{37}$— (2), $CH_3$— (5) | 2 |
| A-14 | (n)$C_{17}H_{35}CONH$— (2) | 1 |
| A-15 | (n)$C_{12}H_{25}NHCOCH_2$— (2,5) | 2 |
| A-16 | $CH_3O$— (2), (t)$C_{15}H_{31}$— (5) | 2 |
| A-17 | (sec)$C_{16}H_{33}$— (2), (t)$C_4H_9$— (5) | 2 |
| A-18 | (t)$C_4H_9$— (2), (sec)$C_{15}H_{31}CONH$— (5) | 2 |
| A-19 | 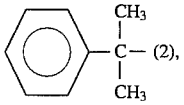 (2), (n)$C_{16}H_{33}COO(CH_2)_3$— (5) | 2 |
| A-20 | 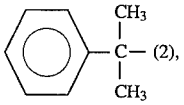 (2), $CH_3$— (5) | 2 |
| A-21 | (sec)$C_{12}H_{25}$— (2), Br— (5), Cl— (6) | 3 |
| A-22 | (n)$C_{12}H_{25}OC(=O)$— (2) | 1 |
| A-23 | (t)$C_{10}H_{21}$— (2), $CH_3$— (5,6) | 3 |
| A-24 | (t)$C_{15}H_{31}$— (2), —$SO_3H$ (3), $CH_3$— (5,6) | 4 |

For the purposes of prevention of color stains, methods of using various hydroquinones have been proposed. For instance, using monoalkylhydro quinones the alkyl moiety of which has a straight-chain structure is disclosed; e.g., in U.S. Pat. Nos. 2,728,657 and JP-A-47-106329 , while using the monoalkylhydro quinones the alkyl moiety of which has a branched chain structure is disclosed in U.S. Pat. No. 3,700,453, West German Patent (Laid-open) 2,149,789, JP-A-50-156438 and JP-A-49-106329.

Further, the dialkylhydroquinones the alkyl moiety of which has a straight-chain structure are disclosed, e.g., U.S. Pat. Nos. 2,728,657 and 2,732,300, British Patents 752,146 and 1,086,208, and *Chemcial Abstracts*, vol. 58, 6367h, and the dialkylhydroquinones the alkyl moiety of which has a branched chain structure are disclosed in U.S. Pat. Nos. 3,700,453 and 2,732,300, British Patent 1,086,208, the above-cited *Chemcial Abstracts*, JP-A-50-156438, JP-A-50-21249, JP-A- 56-40818 and so on.

Moreover, using alkylhydroquinones as color stain inhibitors is disclosed in British Patents 558,258, 557,750 (corresponding to U.S. Pat. No. 2,360,290), 557,802, 731,301 (corresponding to U.S. Pat. No. 2,701,197), U.S. Pat. Nos. 2,336,327, 2,403,721 and 3,582,333, West German Patent (Laid-open) 2,505,016 (corresponding to JP-A-50-110337), and JP-B-56-40816 (the term "JP-B" as used herein means an "examined Japanese patent publication").

In addition, alkylhydroquinones as color stain inhibitors are also described in *Research Disclosure*, No. 176 (1978) (at page 17643, VII-I).

In the foregoing disclosed arts, however, there is no description of a marked improvement brought about in color image fastness by the combined use of the specified hydroquinone compounds having a molecular weight of at least 350 and the present cyan couplers.

Another type of compounds which can be used in combination with the present cyan couplers represented by general formula (Ia) are those selected from the compounds represented by general formula [B], including pyrogallol compounds, resorcinol compounds and catechol compounds.

In general formula [B], the monovalent group represented by $R_{B1}$ is, e.g., a halogen atom, an aliphatic group, a cycloalkyl group, an aromatic group, an alkylthio group, a carbamoyl group, a cyano group, a formyl group, an aryloxy group, an acyloxy group, a carboxyl group or a salt thereof, a sulfo group or a salt thereof, an alkoxycarbonyl group, a cycloalkoxycarbonyl group, an aryloxycarbonyl group, —$COR_{B2}$, —$SO_2R_{B3}$, —$CONHR_{B4}$ or —$NHCOR_{B5}$, wherein $R_{B2}$, $R_{B3}$, $R_{B4}$ and $R_{B5}$ each represent an aliphatic group, an aromatic group or a heterocyclic group.

j represents an integer of 1 to 6; and when j is an integer of 2 to 6, the $R_{B1}$'s may be the same or different. k is 2 or 3; and when k is 2, two (—OH)'s are situated at the ortho or meta position, while three (—OH)'s in case of k=3 are attached to the respective sites which are adjacent to one another. ---$Q_B$--- means that the moiety $Q_B$ may form a naphthalene ring together with the benzene ring.

Representatives of the specific compounds represented by general formula [B] are shown in Table B-1 and Table B-2.

TABLE B-1

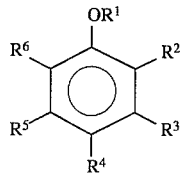

| Compound | $R^1$ | $R^2$ | $R^3$ | $R^4$ | $R^5$ | $R^6$ |
|---|---|---|---|---|---|---|
| B-1 | H | OH | H | $-C_{18}H_{37}(t)$ | H | H |
| B-2 | H | OH | H | 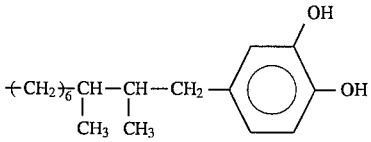 | H | H |
| B-3 | H | OH | H | H | $C_{12}H_{25}(t)$ | H |
| B-4 | H | H | OH | $-C_{18}H_{37}(t)$ | H | H |
| B-5 | H | OH | H | $COOC_{15}H_{31}(n)$ | H | OH |
| B-6 | H | OH | H | $CONHC_{14}H_{29}$ | H | OH |
| B-7 | H | OH | H | $CONH(CH_2)_3OC_{18}H_{37}$ | H | OH |
| B-8 | H | OH | H | $COOC_{18}H_{37}$ | H | OH |

TABLE B-2

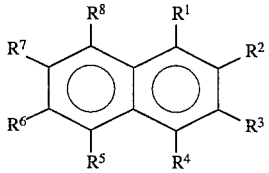

| Compound | $R^1$ | $R^2$ | $R^3$ | $R^4$ | $R^5$ | $R^6$ | $R^7$ | $R^8$ |
|---|---|---|---|---|---|---|---|---|
| B-9 | OH | OH | $C_{16}H_{33}$ | H | H | H | H | H |
| B-10 | OH | OH | H | $C_{16}H_{33}$ | H | H | H | H |
| B-11 | OH | OH | H | H | H | H | $C_{16}H_{33}$ | H |
| B-12 | OH | OH | H | H | H | H | H | $C_{18}H_{37}$ |
| B-13 | H | OH | OH | H | H | H | $C_{16}H_{33}$ | H |
| B-14 | OH | $C_{18}H_{37}$ | OH | H | H | H | H | H |
| B-15 | OH | H | OH | $C_{16}H_{33}$ | H | H | H | H |

The foregoing pyrogallol compounds, catechol compounds and resorcinol compounds are disclosed, e.g., in Belgian Patent 868,441 and JP-A-58-156993.

In the above-cited patents, however, there is no description of a remarkable improvement made in light fastness by combined use of the specific pyrogallol, catechol or resorcinol compounds and the present cyan couplers.

Compounds of the other type which can be used in combination with the present cyan couplers are sulfonylamino compounds represented by general formula [C].

In general formula [C], A represents —CO— or —$SO_2$—, and $R_{C1}$ and $R_{C2}$ each represent an alkyl group, an aryl group, a heterocyclic group or an amino group.

In general formula [C], the alkyl groups represented by $R_{C1}$ and $R_{C2}$ may take a straight-chain or branched form, and preferably contain 1 to 30 carbon atoms.

The aryl groups represented by $R_{C1}$ and $R_{C2}$ preferably contain 6 to 30 carbon atoms.

The heterocyclic groups represented by $R_{C1}$ and $R_{C2}$ preferably contain at least one oxygen or nitrogen atom as hetero atom and 5 to 30 carbon atoms.

The amino groups represented by $R_{C1}$ and $R_{C2}$ include alkyl- or aryl-substituted ones.

The foregoing groups represented by $R_{C1}$ and $R_{C2}$ include those having substituent group(s).

$R_{C3}$ represents a monovalent group, and the monovalent group includes the same as those given for the groups represented by $R_{B1}$ in general formula [B].

m represents an integer of 0 to 2; and when m is 2, two (—NH—A—$R_{C2}$)'s may be the same or different.

n represents an integer of 0 to 2, provided that the sum of m and n is 1 or 2.

Additionally, the position at which at least either —NH—A—$R_{C2}$ or —OH is attached has the ortho or para relationship to the position of —$NHSO_2R_{C1}$.

p is an integer of 0 to 6; and when p is in the range of 2 to 6, the $R_{C3}$'s may be the same or different.

---$Q_C$--- means that the moiety $Q_C$ may form a naphthalene ring together with the benzene ring.

The compounds represented by general formula [C] can be synthesized using known methods. For details of the synthesis methods, JP-A-59-5247, JP-A-59-192247, JP-A-59-195239, JP-A-59-204040, JP-A-60-108843, JP-A-60-118836 and so on can be referred to.

In those patent specifications, however, there is no description of the remarkable improvement brought about in light fastness by the combined use of specified sulfonylamino compounds and the present cyan couplers.

Specific examples of the sulfonylamino compound represented by general formula [C] are illustrated below:

C-1

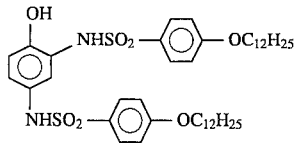

C-2

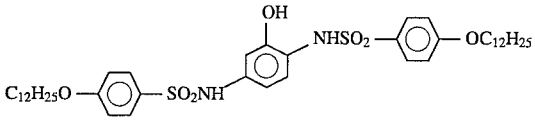

C-3

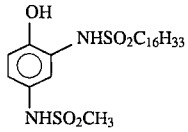

C-4

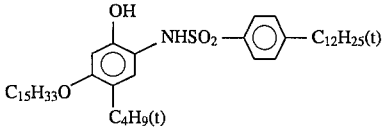

C-5

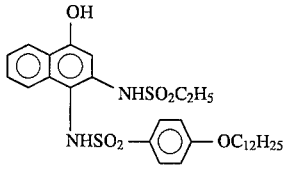

-continued

C-6

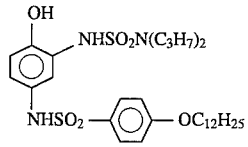

C-7

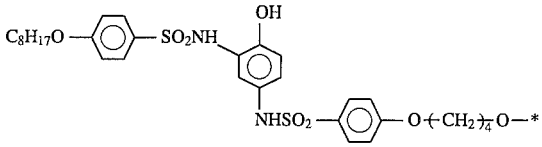

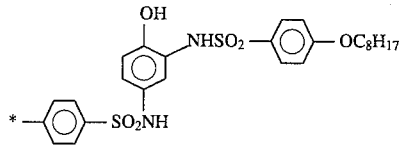

C-8

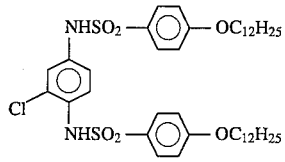

C-9

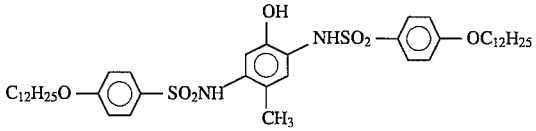

C-10

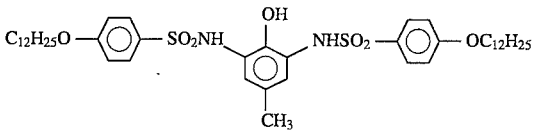

C-11

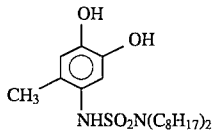

C-12

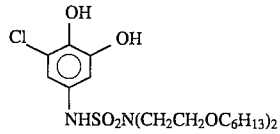

C-13

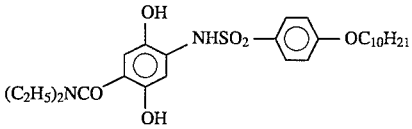

C-14

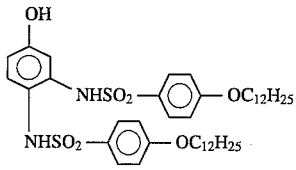

-continued

C-15

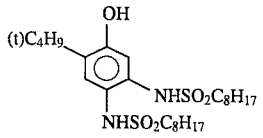

C-16

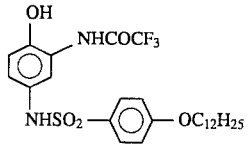

C-17

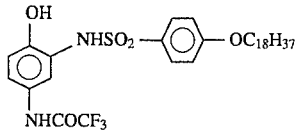

C-18

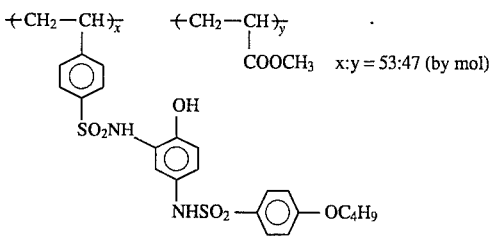

x:y = 53:47 (by mol)

C-19

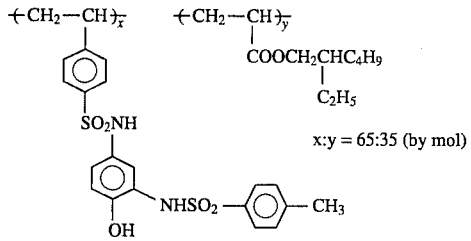

x:y = 65:35 (by mol)

The present compounds of general formula [A], [B] or [C] may be incorporated in any constituent layer. However, it is desirable that they be incorporated in a light-insensitive layer, such as a so-called interlayer, ultraviolet-absorbing layer or protective layer, especially in an interlayer.

The compounds of general formula [A], [B] or [C] are used in an amount of $1\times10^{-3}$ to 1 mole, preferably $5\times10^{-2}$ to $5\times10^{-1}$ mole, particularly preferably $1\times10^{-2}$ to $1\times10^{-1}$ mole, per mole of the present cyan coupler.

Of the foregoing compounds, the compounds of formula [A] are preferred over others.

The substituents specified in general formulae [A], [B] and [C] respectively are chosen so that the resulting compound may have a molecular weight of at least 350. This is because the effects of the present invention can be achieved to a considerable extent only when said compounds have a molecular weight of 350 or more. Though said compounds have no particular restriction as to molecular weight as far as their molecular weight is not less than 350, it is desirable that their molecular weight be less than about 800 when, they have the form of monomer. On the other hand, the compounds represented by general formulae [A], [B] and [C] respectively may be high molecular compounds formed by connecting a polymer chain to their respective substituents. Also, they may be a dimer or higher polymer.

It is desirable that the present redox compounds of general formulae [A], [B] and [C] be present in a color stain-inhibiting layer in the form of fine oil drops prepared by dissolving them in high boiling organic solvents and dispersing the resulting solutions through emulsification.

As for the high boiling organic solvents used in the present invention, those having a dielectric constant of at least 3.5 are preferable. Much preferred as high boiling organic solvents are those having a dielectric constant of at least 5.0. These high boiling organic solvents may be used as mixture of two or more thereof. The dielectric constant of such a mixture is preferably at least 4.0, and more preferably at least 5.0.

Suitable examples of the high boiling organic solvents as described above include esters having a dielectric constant of at least 3.5, such as phthalic acid esters, phosphoric acid esters, etc., organic acid amides and ketones.

As the dielectric constant, there was employed the value determined by the transformer bridge method through the measurement (with, e.g., TRS-10T, made by Ando Denki K.K.) under the condition of 25° C. and 10 kHz.

It is desirable that the boiling point of such high boiling organic solvents not be lower than 140° C., preferably 160° C., and the melting point thereof not be higher than 100° C., preferably 70° C. Also, the high boiling organic solvents used herein may be in a solid state at ordinary temperature. In this case, their dielectric constants are measured in a liquid state (i.e., a supercooled state).

The silver halide emulsions used in the present invention can contain a wide variety of compounds or precursors thereof for the purpose of preventing fog or stabilizing photographic functions during production, storage, or photographic processing. Specific examples of such compounds which can be preferably used in the present invention include those disclosed in JP-A-62-215272, at pages 39 to 72.

As for the magenta coupler, it is desirable that pyrazolotriazole type compounds be used in the present invention, though any known magenta couplers also can be used.

Among the pyrazoloazole type couplers, the imidazo[1,2-b]pyrazoles disclosed in U.S. Pat. No. 4,500,630 are preferred in view of the low yellow side absorption of the developed dyes and light fastness thereof, and the pyrazolo[1,5-b] [1,2,4]triazoles disclosed in U.S. Pat. No. 4,540,654 are especially favored in that regard.

In addition, there can be preferably employed pyrazolotriazole type couplers in which the 2-, 3- or 6-position of the pyrazolotriazole ring is substituted by a branched alkyl group, as disclosed in JP-A-61-65245; pyrazoloazole type couplers which contain a sulfonamido group in a molecule, as disclosed in JP-A-61-65246; pyrazoloazole type couplers which contain an alkoxyphenylsulfonamido group as a ballast group, as disclosed in JP-A-61-147254; and pyrazolotriazole type couplers in which the 6-position is substituted by an alkoxy or aryloxy group, as disclosed in European Patents (laid open) 226,849 and 294,786.

Specific examples of those pyrazoloazole couplers include Couplers I-1 to 1-50 illustrated in EP-A2-0355660, at pages 9 to 28.

Silver halides which can be used in the present invention include silver chloride, silver bromide, silver chlorobromide, silver iodochlorobromide, silver iodobromide and so on. In particular, it is desirable for rapid processing to use a substantially iodide-free silver chloride or chlorobromide emulsion having a chloride content of at least 90 mole %, preferably at least 95 mole %, and particularly preferably at least 98 mole %. The expression "substantially iodide-free" as used herein means that the iodide content is preferably at most 1.0 mole %.

It is desirable that the silver halide grains of the present invention have bromide-rich localized phases of a layer form or nonlayer form, in which the bromide content is at least 10 mole %, inside and/or at the surface of the grains. In view of not only suitability for continuous processing but also pressure resistance, it is preferable that the bromide-rich localized phases be present in the vicinity of grain surface. The term "the vicinity of grain surface" as used herein is defined as the location which is within one-fifth the grain size of the outermost surface. It is much preferable that the bromide-rich localized phases be situated within one-tenth the grain size of the outermost surface and shorter than one-tenth the grain size. As for the configuration of the bromide-rich localized phases, it is most desirable that the localized phases having a bromide content of at least 10 mole % make epitaxial growth on the corners of cubic or detradecahedral silver chloride grains.

Although it is desirable that the bromide contents in the bromide-rich localized phases not be lower than 10 mole %, too high bromide contents in the localized phases sometimes give the photosensitive materials undesirable characteristics such that desensitization tends to occur when stress is imposed on the photosensitive materials. In this respect the sensitivity and the gradation obtained in the final stage a continuous processing are different greatly from those in the initial stage thereof, and so on. Taking account into these points, the bromide content in the bromide-rich localized phase is preferably in the range of 10 to 60 mole %, most preferably 20 to 50 mole %. The bromide content in the bromide-rich localized phase can be determined by an X-ray diffraction method (described, e.g., in "Shin Jikken Kagaku Koza 6, Kozo Kaiseki" (which means "new lectures on experimental chemistry, vol. 6, structural analyses"), compiled by the Japanese Chemical Society and published by Marzen. It is preferable that the silver contained in the bromide-rich localized phases comprise 0.1 to 20 mole %, especially 0.2 to 5 mole %, of the whole silver contained in the individual silver halide grains.

The interfaces between these bromide-rich localized phases and other phases may have a clear phase boundaries, or may have a transformed range in which the halogen composition changes gradually.

Bromide-rich localized phases as described above can be formed using various methods. For instance, the localized phases can be formed by reacting a water-soluble silver salt with a water-soluble halide in accordance with a single jet method or a double jet method. As another method for forming the localized phases, mention may be made of a conversion method in which the silver halide of once formed silver halide grains are partly converted to another silver halide having a solubility product lower than that of the former halide. Also, it is advantageous to form bromide-rich localized phases by mixing host silver halide grains having a cubic or tetradecahedral crystal shape with fine grains of silver halide which have a smaller average grain size and a higher bromide content than the host grains, and then ripening the mixed grains.

An average size of the silver halide grains contained in the silver halide emulsions used in this invention (the grain size herein refers to the diameter of the circle having the same area as the projected area of the grain, and the number average is taken in expressing the grain size) ranges preferably from 0.1 to 2 μm.

As for the distribution of sizes among grains, so-called monodisperse emulsions which have a variation coefficient (the value obtained by dividing the standard deviation of grain size distribution by the average grain size) of at most 20%, desirably at most 15%, are preferred. For the purpose of obtaining a wide latitude, it is advantageous to coat a blend of some monodisperse emulsions differing in average grain size in a single layer, or to coat them separately in a multiple layer.

Those silver halide grains contained in the present photographic emulsions may have a regular crystal form, such as that of a cube, a tetradecahedron or an octahedron; an irregular crystal form, such as that of a sphere, a plate or so on; or a composite form. Also, they may be a mixture of silver halide grains having various crystal forms. It is desirable in the present invention that the proportion of silver halide grains having such a regular crystal form as described above to the whole silver halide grains present in each photographic emulsion should be at least 50 mol %, preferably at least 70 mol %, and much preferably at least 90 mol %.

Also, it is desirable in this invention to use such an emulsion as to contain tabular silver halide grains having an average aspect ratio (a ratio of a projected area diameter to a thickness) of at least 5, preferably at least 8, in a proportion of at least 50%, based on the projected area, to the whole silver halide grains present therein.

The emulsions of the present invention can be prepared using various methods as described in, for example, P. Glafkides, *Chemie et Phisique Photographique*, Paul Montel, Paris (1967); G. F. Duffin, *Photographic Emulsion Chemistry*, The Focal Press, London (1966), V. L. Zelikman et al, *Making and Coating Photographic Emulsion*, The Focal Press, London (1964); and so on. Specifically, any processes including an acid process, a neutral process and an ammoniacal process may be employed.

Suitable methods for reacting a water-soluble silver salt with a water-soluble halide include, e.g., a single jet method, a double jet method, or a combination thereof. Also, a method in which silver halide grains are produced in the presence of excess silver ion (the so-called reverse mixing method) can be employed. On the other hand, the so-called controlled double jet method, in which the pAg of the liquid phase in which silver halide grains are to be precipitated is maintained constant, may be also employed. According to this method, a silver halide emulsion having a regular crystal form and an almost uniform distribution of grain sizes can be obtained.

In a process of producing silver halide grains or allowing the produced silver halide grains to ripen physically, various kinds of polyvalent metal ion dopants can be introduced. Examples of compounds usable as dopants include cadmium salts, zinc salts, lead salts, copper salts, thallium salts, and single or complex salts of Group VIII elements such as iron, ruthenium, rhodium, palladium, osmium, iridium, platinum, etc. In particular, the complex salts of Group VIII elements are used to advantage. Amounts of these compounds to be added, though can be varied over a wide range depending on the purpose, are preferably within the range of $10^{-9}$ to $10^{-2}$ mole per mole of silver halide.

The silver halide emulsions to be used in the present invention are, in general, chemically and spectrally sensitized.

As for the chemical sensitization process, a sensitization process using a chalcogen compound, such as sulfur sensitization, selenium sensitization, tellurium sensitization or the like, a sensitization process using a noble metal compound represented by a gold compound and a reduction sensitization process can be employed individually or as a combination of two or more thereof. Preferred compounds used for chemical sensitization are those disclosed in JP-A-62-215272, from the right lower column at page 18 to the right upper column at page 22.

Spectral sensitization to which silver halide emulsions used in the present invention are subjected is performed for the purpose of imparting spectral sensitivities in a desired wavelength region of light to an emulsion which constitutes each light-sensitive layer of the present photographic material. It is preferred in the present invention to effect the spectral sensitization by addition of dyes capable of absorbing light in the wavelength region corresponding to desired spectral sensitivities, that is to say, spectral sensitizing dyes. Spectral sensitizing dyes which can be used for the above-described purpose include those described, e.g., in F. M. Harmer, *Heterocyclic compound—Cyanine dyes and related compounds*, John Wiley & Sons, New York and London (1964). Specific examples of compounds and spectral sensitization processes which can be employed to advantage in the present invention include those disclosed in JP-A-62-215272, from the right upper column on the page 22 to the page 38.

The so-called surface latent-image type emulsions, or silver halide emulsions of the kind which form a latent image predominantly at the surface of the grains, are preferred as the emulsions used in the present invention.

For the purpose of enhancement of image sharpness and the like, it is desirable (i) that dyes capable of undergoing decolorization by photographic processing (especially oxonol dyes), which are disclosed at pages 27 to 76 in EP-A2-0337490, be added to a hydrophilic colloid layer of the present photographic material in such an amount as to impart an optical reflection density of at least 0.70 at 680 nm to the resulting photographic material, and (ii) that titanium oxide grains which have undergone surface treatment with a di- to tetrahydric alcohol (e.g., trimethylolethane) be incorporated in a content of at least 12 wt % (preferably at least 14 wt %) into a waterproof resin coating of the support.

Photographic additives which can be used in the present invention, including cyan, magenta and yellow couplers, are preferably dissolved in a high boiling organic solvent. Such a high boiling organic solvent is a water-immiscible compound having a melting point of 100° C. or lower and a boiling point of 140° C. or higher and is a good solvent for couplers. The melting point of preferable high boiling organic solvents is 80° C. or lower and the boiling point thereof is 160° C. or higher, much preferably 170° C. or higher.

Details of such high boiling organic solvents are described in JP-A-62-215272, from the right lower column at page 137 to the right upper column at page 144.

On the other hand, a loadable latex polymer (as disclosed, e.g., in U.S. Pat. No. 4,203,716) impregnated with a cyan, magenta or yellow coupler in the presence or absence of a high boiling organic solvent as described above, or such a coupler dissolved in a high boiling organic solvent together with a polymer insoluble in water but soluble in an organic solvent, can be dispersed into a hydrophilic colloid solution in an emulsified condition.

Polymers which can be preferably used therein include the homo- or copolymers disclosed in U.S. Pat. No. 4,857,449, from column 7 to column 15, and WO 88/00723, from page 12 to page 30. Much preferably, polymers of methacrylate or acrylamide type, particularly those of acrylamide type, are favored over others in view of color image stabilization and so on.

Furthermore, it is desirable for improving the keeping quality of color images that the compounds as disclosed in EP-0277589A2 be used together with couplers in the photographic material of the present invention. In particular, it is preferable that such compounds be used in combination with couplers of the pyrazoloazole type and those of the pyrroloazole type.

That is, compounds of the kind which can produce chemically inert, substantially colorless compounds by combining chemically with an aromatic amine developing agent remaining after the color development-processing (Compound F) and/or compounds of the kind which can produce chemically inert, substantially colorless compounds by combining chemically with the oxidized aromatic amine developing agent remaining after the color development-processing (Compound G) are preferably used in combination or independently. By the use of these compounds, the generation of stains, which are due to the formation of dyes through the reaction between the couplers and the unoxidized or oxidized color developing agent remaining in the processed photographic film, and the occurrence of other side reactions upon storage after photographic processing, can be inhibited effectively.

Also, it is desirable that the antimolds disclosed in JP-A-63-271247 be added to the photographic material of the present invention in order to prevent a deterioration of images from occurring through propagation of various kinds of molds and bacteria in hydrophilic colloid layers.

As for the support of the present photographic material, a support of reflection type and a transparent support may be both used. However, a support of the reflection type is desirable in particular for accomplishing the present purposes.

For the display purpose, a support of the white polyester type or a support provided with a white pigment-containing layer on the same side as the silver halide emulsion layers may be employed.

The photographic material of the present invention may be exposed to either visible or infrared rays. For the exposure, not only low intensity exposure but also high intensity short-time exposure may be employed. In the latter case, a laser scanning exposure system in which the exposure time per picture element is shorter than $10^{-4}$ second is preferred in particular.

Upon exposure, it is preferable to use the band stop filter disclosed in U.S. Pat. No. 4,880,726. This filter can get rid of color stain of optical origin to improve color reproducibility to a great extent.

After exposure, photographic materials can be subjected to a conventional black-and-white or color photographic processing. In case of the color photographic materials, it is desirable for rapid processing that the materials be subjected to a bleach-fix step after color development. In a special case where a high chloride-content silver halide emulsion is used, it is desirable for promotion of the desilvering step that the pH of the bleach-fix bath be adjusted to about 6.5 or lower, preferably about 6 or lower.

As for the silver halide emulsions and other ingredients (such as additives, etc.) and the photographic constituent layers (including their order of arrangement), those disclosed in the following patent specifications, especially EP0355660A2 (corresponding to JP-A-02-139544) can be preferably applied to the photographic material of the present invention.

| Photographic Constituents | JP-A-62-215272 | JP-A-02-33144 | EP0355660 A2 |
|---|---|---|---|
| Silver halide emulsions | from 6th line in right upper column at page 10 to 5th line in left lower column at page 12, and from 4th line from the bottom of right lower column at page 12 to 17th line in left upper column at page 13 | from 16th line in right upper column at page 28 to 11th line in right lower column at page 29, and from 2nd line to 5th line at page 30 | from 53rd line at page 45 to 3rd line at page 47, and from 20th line to 22nd line at page 47 |
| Silver halide solvents | from 6th line to 14th line in left lower column at page 12, and from 3rd line from the bottom of left upper column at page 13 to the end line in left lower column at page 18 | | |
| Chemical sensitizers | from 3rd line in left lower column to 5th line in right lower column at page 12, and from 1st line in right lower column at page 18 to 9th line from the bottom of right upper column at page 22 | from 12th line to end line in right lower column at page 29 | from 4th line to 9th line at page 47 |
| Spectral sensitizers (Spectral sensitizing methods) | from 8th line from the bottom of right upper column at page 22 to end line at page 38 | from 11th to 13th in left upper column at page 30 | from 10th line to 15th line at page 47 |
| Emulsion stabilizers | from 1st line in left upper column at page 39 to end line in right upper column at page 72 | from 14th line in left upper column to 1st line in right upper column at page 30 | from 16th line to 19th line at page 47 |
| Development accelerators | from 1st line in left lower column at page 72 to 3rd line in right upper column at page 91 | | |
| Color couplers (cyan, magenta and yellow couplers) | from 4th line in right upper column at page 91 to 6th line in left upper column at page 121 | from 14th line in right upper column at page 3 to end line in left upper column at page 18, and from 6th line in right upper column at page 30 to 11th line in right lower column at page 35 | from 15th line to 27th line at page 4, from 30th line at page 5 to end line at page 28, from 29th line to 31st line at page 45, and from 23rd line at page 47 to 50th line at page 63 |
| Color formation reinforcing agents | from 7th line in left upper column at page 121 to 1st line in right upper column at page 125 | | |
| Ultraviolet absorbents | from 2nd line in right upper column at page 125 to end line in left lower column at page 127 | from 14th line in right lower column at page 37 to 11th line in left upper column at page 38 | from 22nd line to 31st line at page 65 |
| Discoloration inhibitors (image stabilizers) | from 1st line in right lower column at page 127 to 8th line in left lower column at page 137 | from 12th line in right upper column at page 36 to 19th line in left upper column at page 37 | from 30th line at page 4 to 23rd line at page 5, from 1st line at page 29 to 25th line at page 45, from 33rd line to 40th line at page 45, and from 2nd line to 21st line at page 65 |
| High boiling and/or low | from 9th line in left lower column | from 14th line in right lower column | from 1st line to 51st line at page 64 |

-continued

| Photographic Constituents | JP-A-62-215272 | JP-A-02-33144 | EP0355660 A2 |
|---|---|---|---|
| boiling organic solvents | at page 137 to end line in right upper column at page 144 | at page 35 to 4th line in left upper column at page 36 | |
| Dispersion methods for photographic additives | from 1st line in left lower column at page 144 to 7th line in right upper column at page 146 | from 10th line in right lower column at page 27 to end line in left upper column at page 28, and from 12th line in right lower column at page 35 to 7th line in right upper column at page 36 | from 51st line at page 63 to 56th line at page 64 |
| Hardeners | from 8th line in right upper column at page 146 to 4th line in left lower column at page 155 | | |
| Precursors of developing agents | from 5th line in left lower column at page 155 to 2nd line in right lower column at page 155 | | |
| Development inhibitor releasing | from 3rd line to 9th line in right lower column at page 155 | | |
| Supports | from 19th line in right lower column at page 155 to 14th line in left upper column at page 156 | from 18th line in right upper column at page 38 to 3rd line in left upper column at page 39 | from 29th line at page 66 to 13th line at page 67 |
| Light-sensitive layer structures | from 15th line in left upper column at page 156 to 14th line in right lower column at page 156 | from 1st line to 15th line in right upper column at page 28 | from 41st line to 52nd line at page 45 |
| Dyes | from 15th line in right lower column at page 156 to end line in right lower column at page 184 | from 12th line in left upper column to 7th line in right upper column at page 38 | from 18th line to 22nd line at page 66 |
| Color stain inhibitors | from 1st line in left upper column at page 185 to 3rd line in right lower column at page 188 | from 8th line to 11th line in right upper column at page 36 | from 57th line at page 64 to 1st line at page 65 |
| Tone modifiers | from 4th line to 8th line in right lower column at page 188 | | |
| Stain inhibitors | from 9th line in right lower column at page 188 to 10th line in right lower column at page 193 | from end line in left upper column to 13th line in right lower column at page 37 | from 32nd line at page 65 to 17th line at page 66 |
| Surfactants | from 1st line in left lower column at page 201 to end line in right upper column at page 210 | from 1st line in right upper column at page 18 to end line in right lower column at page 24, and from 10th line from the bottom of left lower column 9th line in right to lower column at page 27 | |
| Fluorine-containing compounds (antistatic agents, coating aids, lubricants, adhesion inhibitors, etc.) | from 1st line in left lower column at page 210 to 5th line in left lower column at page 222 | from 1st line in left upper column at page 25 to 9th line in right lower column at page 27 | |
| Binders | from 6th line in | from 8th line to | from 23rd line to |

-continued

| Photographic Constituents | JP-A-62-215272 | JP-A-02-33144 | EP0355660 A2 |
|---|---|---|---|
| (hydrophilic colloids) | left lower column at page 222 to end line in left upper column at page 225 | 18th line in right upper column at page 38 | 28th line at page 66 |
| Thickening agents | from 1st line in left lower column at page 225 to 2nd line in right upper column at page 227 | | |
| Antistatic agents | from 3rd line in right upper column at page 227 to 1st line in left upper column at page 230 | | |
| Polymer latexes | from 2nd line in left upper column at page 230 to end line at page 239 | | |
| Matting agents | from 1st line in left upper column to end line in right upper column at page 240 | | |

Note)
The quoted paragraphs of JP-A-62-21527 are intended to include the contents of amendments dated March 16 in 1987 which were given in the end of the bulletin.

As for the yellow couplers, the so-called blue-shift type couplers disclosed in JP-A-63-231451, JP-A-63-123047, JP-A-63-241547, JP-A-01-173499, JP-A-01-213648 and JP-A-01-250944 are preferably used in addition to those cited in the above references. Also, the cycloalkaneacetanilide type yellow couplers disclosed in JP-A-01-116643 and the indolinocarbonylanilide type yellow couplers disclosed in European Patent 0,482,552 can be used to advantage.

As for the method for processing silver halide color photographic materials using high chloride-content emulsions having a chloride content of at least 90 mole %, there are preferably employed the methods disclosed in JP-A-02-207250, from the left upper column at page 27 to the right upper column at page 34.

The present invention will now be illustrated in more detail by reference to the following examples. However, the invention should not be construed as being limited to these examples.

EXAMPLE 1

The surface of a paper support laminated with polyethylene on both sides was subjected to a corona discharge operation, provided with a gelatin undercoat containing sodium dodecylbenzenesulfonate, and further coated with various photographic constituent layers to prepare a multilayer color photographic paper having the following layer structure (Sample No. 101). Coating solutions used herein were prepared in the manner described below.

Preparation of Coating Solution for Fifth Layer;

A cyan coupler (ExC) in the amount of 33 g, 18.0 g of an ultraviolet absorbent (UV-2), 2.0 g of a color image stabilizer (Cpd-9), 2.0 g of a color image stabilizer (Cpd-10), 1.0 g of a color image stabilizer (Cpd-6), 44 g of a solvent (Solv-6), 1.0 g of a color image stabilizer (Cpd-11), 1.0 g of a solvent (Solv-1) and 33 g of a color image stabilizer (Cpd-1) were admixed with 60.0 ml of ethyl acetate and dissolved thereinto. The solution obtained was added to 500 ml of a 20% aqueous gelatin solution containing 8 g of sodium dodecylbenzenesulfonate, and dispersed thereinto in an emulsified condition by means of a high-speed rotary homogenizer to prepare an emulsified dispersion.

On the other hand, two kinds of silver chlorobromide emulsions [both of which had a cubic crystal form; one of which had an average grain size of 0.50 μm and a variation coefficient of 0.09 with respect to the grain size distribution (large-sized Emulsion R1), and the other of which had an average grain size of 0.41 μm and a variation coefficient of 0.11 with respect to the grain size distribution (small-sized Emulsion R2); both of which were constituted of 0.8 mol % bromide, localized in part of each grain surface, and the remainder chloride] were prepared. Further, the red-sensitive dye E illustrated below was added to the large-sized Emulsion R1 and the small-sized Emulsion R2 in the amounts of $0.9\times10^{-4}$ mole and $1.1\times10^{-4}$ mole, respectively, per mole of silver. These emulsions R1 and R2 were mixed in a ratio of 1:4 by mole on a silver basis to obtain a silver chlorobromide Emulsion R. Furthermore, Compound F illustrated below was added to Emulsion R in the amount of $2.6\times10^{-3}$ mole per mole of silver. The resulting Emulsion R was chemically ripened by the addition of a sulfur sensitizer and a gold sensitizer.

The thus prepared red-sensitive silver chlorobromide emulsion R was mixed homogeneously with the foregoing emulsified Dispersion. Thereto were added other ingredients described below so as to obtain the coating solution for the fifth layer having the following composition.

Coating solutions for other layers were prepared respectively in the same manner as that for the fifth layer. In each layer, sodium salt of 1-oxy-3,5-dichloro-s-triazine was used as gelatin hardener.

In addition, Cpd-14 and Cpd-15 were added to all layers so that their coverages were 25.0 mg/m$^2$ and 50.0 mg/m$^2$, respectively.

Spectral sensitizing dyes illustrated below were added to the silver chlorobromide emulsions for each light-sensitive emulsion layer.

Blue-sensitive Emulsion Layer

Sensitizing Dye A

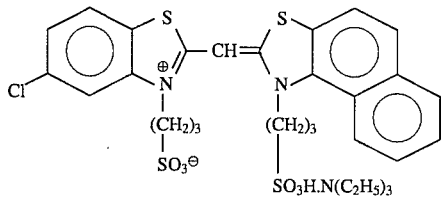

and

Sensitizing Dye B

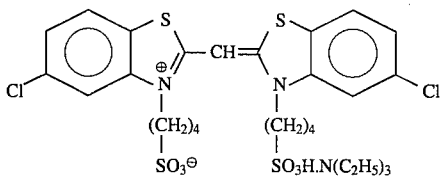

(Sensitizing Dyes A and B illustrated above were added to the large-sized emulsion in the same amount of $2.0\times10^{-4}$ mole per mole silver, and to the small-sized emulsion in the same amount of $2.5\times10^{-4}$ mole per mole of silver.)

Green-sensitive Emulsion

Sensitizing Dye C

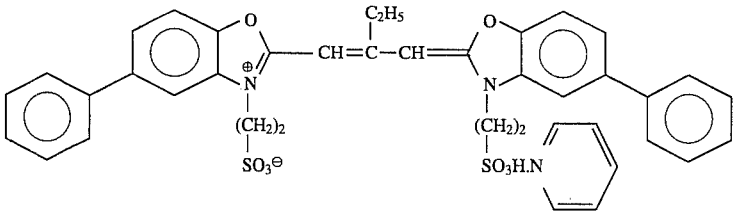

(Sensitizing Dye C illustrated above was added to the large-sized emulsion in the amount of $4.0\times10^{-4}$ mole per mole silver, and to the small-sized emulsion in the amount of $5.6\times10^{-4}$ mole per mole of silver.)

Sensitizing Dye D

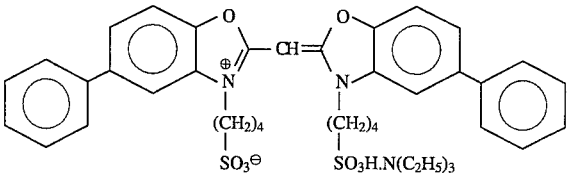

(Sensitizing Dye D illustrated above was added to the large-sized emulsion in the amount of $7.0\times10^{-5}$ mole per mole silver, and to the small-sized emulsion in the amount of $1.0\times10^{-4}$ mole per mole of silver.)

Red-sensitive Emulsion Layer

Sensitizing Dye E

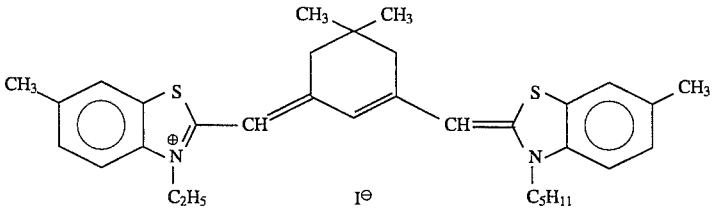

(Sensitizing Dye E was added to the large-sized emulsion in the amount of $0.9\times10^{-4}$ mole per mole silver, and to the small-sized emulsion in the amount of $1.1\times10^{-4}$ mole per mole silver.)

Further, the following compound was added in the amount of $2.6\times10^{-3}$ mole per mole of silver halide:

Compound F

-continued

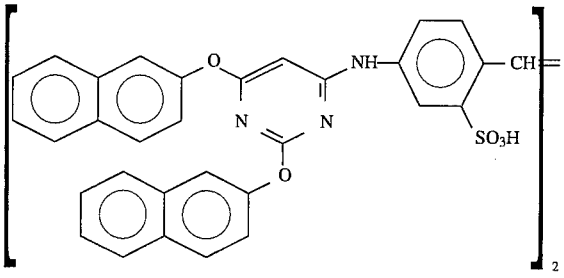

Moreover, 1-(5-methylureidophenyl)-5-mercaptotetrazole was added to the blue-sensitive emulsion layer, the green-sensitive emulsion layer and the red-sensitive emulsion layer in the amounts of $8.5\times10^{-5}$ mole, $7.7\times10^{-4}$ mole and $2.5\times10^{-4}$ mole, respectively, per mole of silver halide.

Furthermore, 4-hydroxy-6-methyl-1,3,3a,7-tetrazaindene was added to the blue-sensitive emulsion layer and the green-sensitive emulsion layer in the amounts of $1\times10^{-4}$ mole and $2\times10^{-4}$ mole, respectively, per mole of silver halide.

In addition, the dyes illustrated below (their respective coverages are designated in parentheses) were added to each emulsion layer in order to inhibit an irradiation phenomenon from occurring.

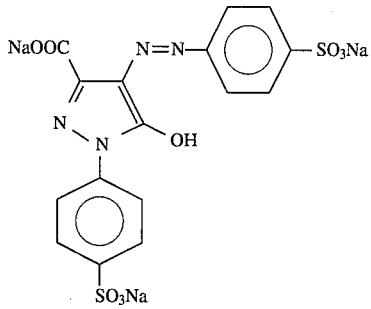

(10 mg/m²)

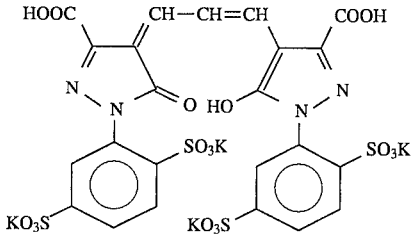

(10 mg/m²)

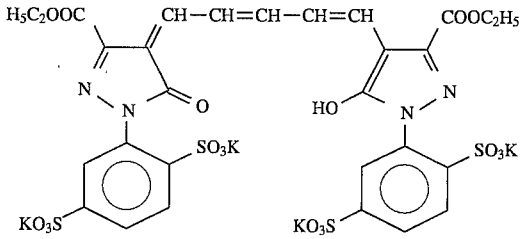

(40 mg/m²)

and

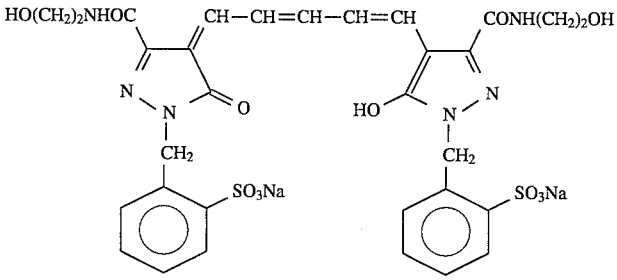

(20 mg/m²)

The composition of each constituent layer is described below. Each figure on the right side designates the coverage ($g/m^2$) of the ingredient corresponding thereto. As for the silver halide emulsion, the figure represents the coverage based on silver.

| | |
|---|---|
| Support: | |
| Polyethylene-laminated paper which contained white pigment ($TiO_2$) and a bluish dye (ultramarine) in the polyethylene laminate on the side of the first layer | |
| First layer (blue-sensitive emulsion layer): | |
| Silver chlorobromide emulsion (having a cubic crystal form, and being a 3:7 (by mole, based on Ag) mixture of a large-sized Emulsion B1 having an average grain size of 0.88 μm and a variation coefficient of 0.08 with respect to grain size distribution and a small-sized Emulsion B2 having an average grain size of 0.70 μm and a variation coefficient of 0.10 with respect to grain size distribution, which each contained 0.3 mol % of AgBr localized in part of the grain surface) | 0.27 |
| Gelatin | 1.36 |
| Yellow coupler (ExY) | 0.67 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.12 |
| Solvent (Solv-2) | 0.12 |
| Second layer (color stain inhibiting layer): | |
| Gelatin | 1.10 |
| Color stain inhibitor (Cpd-4) | 0.08 |
| Solvent (Solv-2) | 0.53 |
| Color image stabilizer (Cpd-7) | 0.03 |
| Third layer (green-sensitive emulsion layer): | |
| Silver chlorobromide emulsion (having a cubic crystal form, and being a 1:3 (by mole, based on Ag) mixture of a large-sized Emulsion G1 having an average grain size of 0.55 μm and a variation coefficient of 0.10 with respect to grain size distribution with a small-sized Emulsion G2 having an average grain size of 0.39 μm and a variation coefficient of 0.08 with respect to grain size distribution, which each contained 0.8 mol % of AgBr localized in part of the grain surface) | 0.13 |
| Gelatin | 1.45 |
| Magenta coupler (ExM) | 0.16 |
| Color image stabilizer (Cpd-5) | 0.15 |
| Color image stabilizer (Cpd-2) | 0.03 |
| Color image stabilizer (Cpd-6) | 0.02 |
| Color image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (color stain inhibiting layer): | |
| Gelatin | 0.70 |
| Color stain inhibitor (Cpd-4) | 0.05 |
| Solvent (Solv-2) | 0.37 |
| Color image stabilizer (Cpd-7) | 0.02 |
| Fifth layer (red-sensitive emulsion layer): | |
| The foregoing silver chlorobromide Emulsion R | 0.20 |
| Gelatin | 0.90 |
| Cyan coupler (ExC) | 0.33 |
| Ultraviolet absorbent (UV-2) | 0.18 |
| Color image stabilizer (Cpd-9) | 0.02 |
| Color image stabilizer (Cpd-10) | 0.02 |
| Color image stabilizer (Cpd-11) | 0.01 |
| Solvent (Solv-6) | 0.44 |
| Color image stabilizer (Cpd-6) | 0.01 |
| Solvent (Solv-1) | 0.01 |
| Color image stabilizer (Cpd-1) | 0.33 |
| Sixth layer (ultraviolet absorbing layer): | |
| Gelatin | 0.55 |
| Ultraviolet absorbent (UV-1) | 0.38 |
| Color image stabilizer (Cpd-12) | 0.15 |
| Color image stabilizer (Cpd-5) | 0.02 |
| Seventh layer (protective layer): | |
| Gelatin | 1.33 |
| Acryl-modified polyvinyl alcohol (modification degree: 17%) | 0.05 |
| Liquid paraffin | 0.02 |
| Color image stabilizer (Cpd-13) | 0.01 |

The structural formulae of the compound used herein are illustrated below:

(ExY) Yellow Coupler

1:1:1:1 (by mole) mixture of

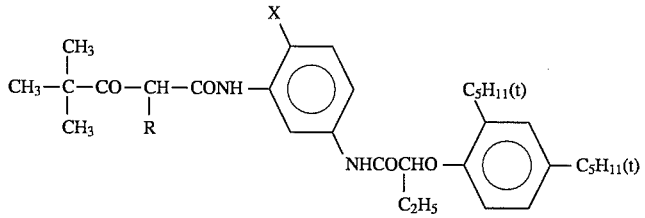

that containing

R = 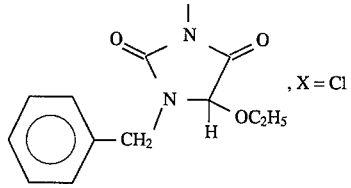 , X = Cl and

-continued
that containing
R = 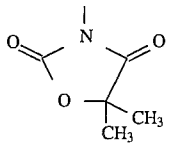 , X = $OCH_3$
and
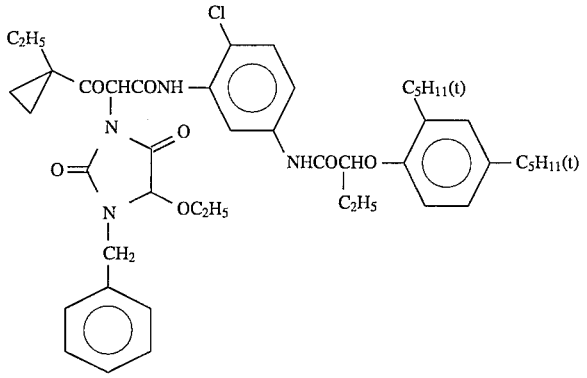
and
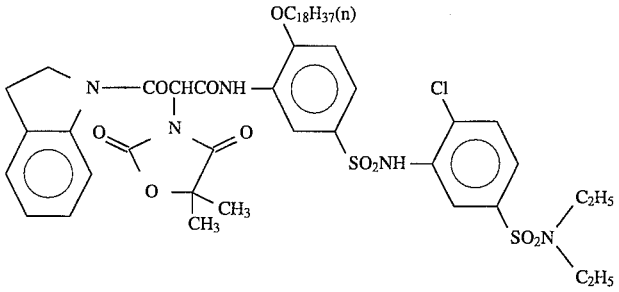
(ExM) Magenta Coupler
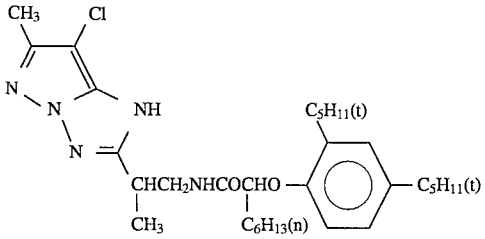
(ExC) Cyan Coupler
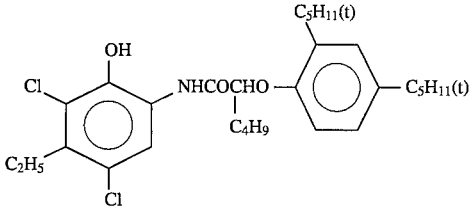
(Cpd-1) Color Image Stabilizer
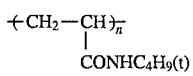
(Average molecular weight: 60,000)

-continued
(Cpd-2) Color Image Stabilizer
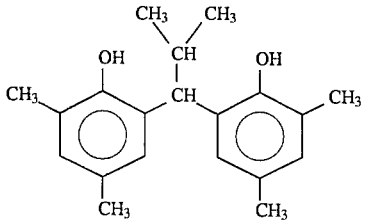
(Cpd-3) Color Image Stabilizer
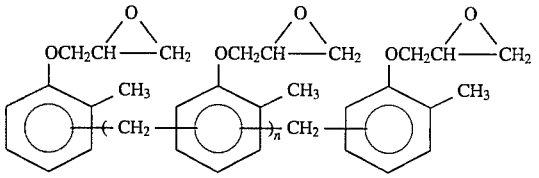
n = 7–8 (on average)
(Cpd-4) Color stain inhibitor
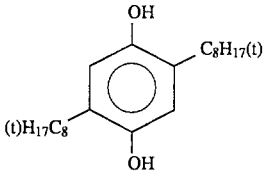
(Cpd-5) Color image stabilizer
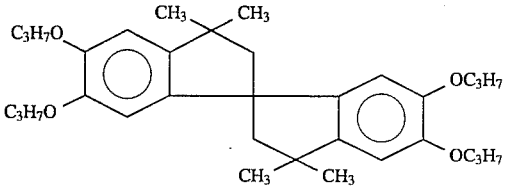
(Cpd-6) Color Image Stabilizer
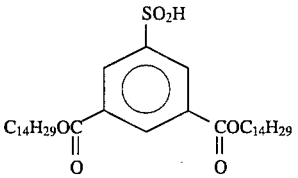
(Cpd-7) Color image stabilizer
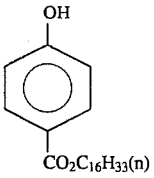
(Cpd-8) Color image stabilizer
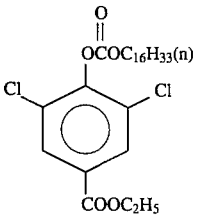

-continued
(Cpd-9) Color Image Stabilizer
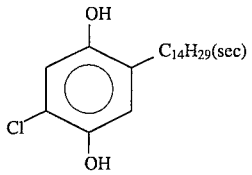
(Cpd-10) Color Image Stabilizer
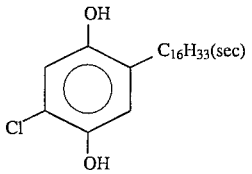
(Cpd-11) Color image stabilizer
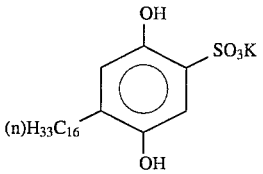
(Cpd-12) Color image stabilizer
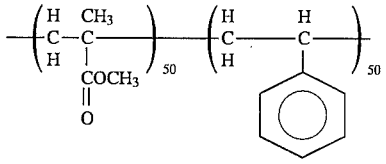
average molecular weight: about $3.0 \times 10^4$
(Cpd-13) Color image stabilizer
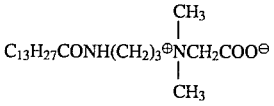
(Cpd-14) Antiseptic
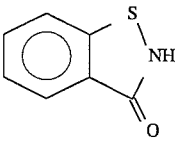
(Cpd-15) Antiseptic
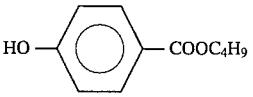
(UV-1) Ultraviolet Absorbent
1:5:10:5 (by weight) Mixture of (1), (2), (3) and (4):

-continued
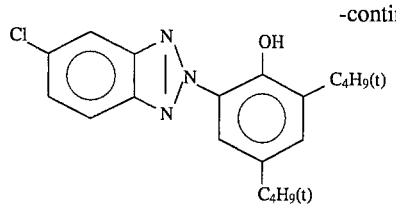
(1)
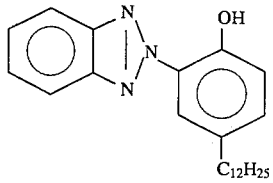
(2)
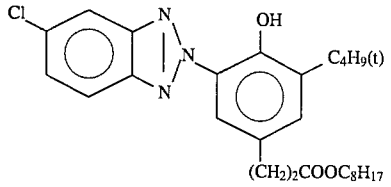
(3)
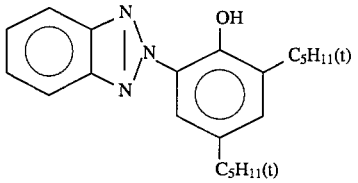
(4)
(UV-2) Ultraviolet absorbent
1:2:2 (by weight) Mixture of (1), (2) and (3):
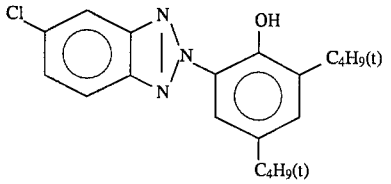
(1)
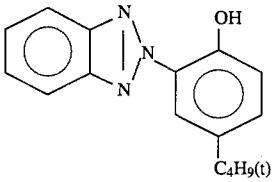
(2)
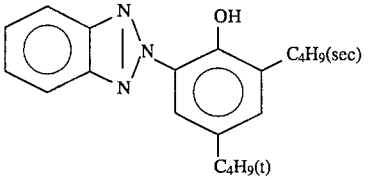
(3)
(Solv-1) Solvent
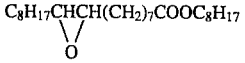
(Solv-2) Solvent
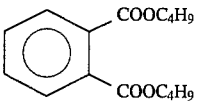

-continued (Solv-3) Solvent

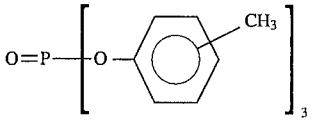

(Solv-4) Solvent

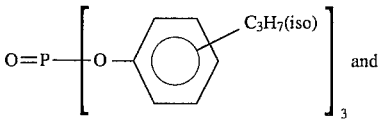

and (Solv-5) Solvent

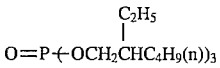

(Solv-6) Solvent

1:1 (by weight) mixture of

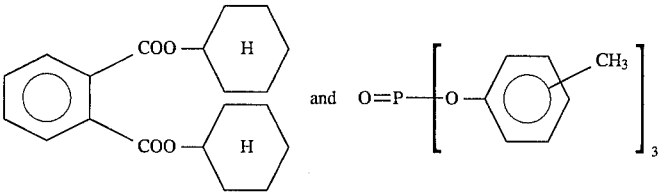

Further, Sample Nos. 102 to 129 were prepared in the same manner as Sample No. 101, except that the compound (Cpd-4), the same as Compound A for comparison, used in the second and fourth layers was changed to those shown in Table I, which were selected from the present redox compounds represented by general formulae [A], [B] and [C] and certain compounds for comparison, and the cyan coupler (ExC) used in the fifth layer were changed to those shown in Table I, which were selected from the present cyan couplers of general formula (Ia).

Therein, the present redox compounds were used in amounts equimolar with the compound (Cpd-4), while the present cyan couplers were used in amounts reduced to one-half (by mole) the amount of the cyan coupler (ExC) used for comparison in order to adjust the densities of developed colors.

First, Sample No. 101 was subjected to gradation exposure using a sensitometer (Model FWH, produced by Fuji Photo Film Co., Ltd., equipped with a light source having a color temperature of 3,200° K.) through separation filters for sensitometry.

Then, continuous processing was performed using the thus exposed sample (taken as a standard sample) and a paper processing machine in which the processing operation was performed in accordance with the following processing steps using the processing solutions having the compositions described below respectively to make the processing solutions in the running equilibrium state. Further, Sample Nos. 101 to 129 exposed in the same manner as described above were processed in accordance with the following processing steps using the processing solutions in the running equilibrium state.

| Processing Step | Temperature | Time | Amount* replenished | Tank Volume |
|---|---|---|---|---|
| Color development | 35° C. | 45 sec. | 161 ml | 17 l |
| Bleach-fix | 30–35° C. | 45 sec. | 215 ml | 17 l |
| Rinsing | 30° C. | 90 sec. | 350 ml | 10 l |
| Drying | 70–80° C. | 60 sec. | | |

*per $m^2$ of photographic material

The composition of each processing solution used is described below.

| Color Developer: | Tank Solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 4.0 g | 5.0 g |
| Brightening agent (WHITEX 4B, produced by Sumitomo Chemical Co., Ltd.) | 1.0 g | 2.0 g |
| Water to make | 1,000 ml | 1,000 ml |
| pH (25° C.) adjusted to | 10.05 | 10.45 |

Bleach-Fix Bath
(Tank solution = Replenisher):

| | |
|---|---|
| Water | 400 ml |
| Ammonium thiosulfate (700 g/l) | 100 ml |

-continued

| | |
|---|---|
| Sodium sulfite | 17 g |
| Ammonium ethylenediaminetetra-acetatoferrate(III) | 55 g |
| Disodium ethylenediaminetetraacetate | 5 g |
| Ammonium bromide | 40 g |
| Water to make | 1,000 ml |
| pH (25° C.) adjusted to | 6.0 |

Rinsing Bath (Tank solution=Replenisher):

Ion exchange water (in which calcium and magnesium ion concentrations were each below 3 ppm).

Each of the thus processed samples which had been exposed so that the developed cyan color might have a density of 1.5 in the area exposed to blue rays of light was examined for the density obtained through measurement with Blue filter ($D_B$) and for the density obtained through measurement with Green filter ($D_G$). From the thus obtained density values were determined the Y-component (yellow component) and M-component (magenta component) defined by the following equations:

$$\text{Y-component}=D_B/1.5 \quad \text{M-component}=D_G/1.5$$

The values of these components mean that the cyan absorption is attended by less side absorption the smaller they are, that is, it can ensure more faithful color reproduction the smaller they are.

In order to evaluate the light fastness of each sample, photodiscoloration tests were performed under the following two conditions (A) and (B), and thereby were determined the discoloration rates of cyan colors in the areas having the initial density of 1.5.

Condition (A):

Under the relative humidity adjusted to about 20%, each sample underwent the 10 days' discoloration test using a 90,000 lux xenon fade-o-meter at room temperature.

Condition (B):

Under the relative humidity adjusted to about 70%, each sample underwent the 10 days' discoloration test using a 90,000 lux xenon fade-o-meter at room temperature.

The compounds illustrated below were used as redox compounds for comparison:

Compound A

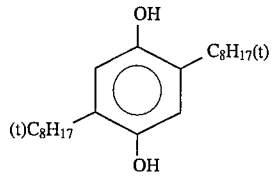

M.W. = 334.6

Compound B

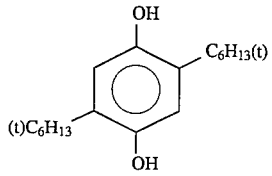

M.W. = 278.4

Compound C

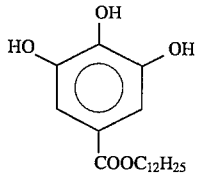

M.W. = 338.4

The results of the foregoing discoloration tests are shown in Table I.

TABLE I

| Sample No. | Redox Compound in 2nd and 4th Layers | Cyan Coupler in 5th Layer | Hue M-Component | Hue Y-Component | Light Fastness Condition A | Light Fastness Condition B | Note |
|---|---|---|---|---|---|---|---|
| 101 | Compound A (the same as Cpd-4) | ExC (coupler for comparison) | 0.26 | 0.17 | 26 | 32 | Comparison |
| 102 | Compound B | ExC | 0.26 | 0.17 | 25 | 33 | Comparison |
| 103 | Compound C | ExC | 0.26 | 0.17 | 26 | 32 | Comparison |
| 104 | A - 3 | ExC | 0.27 | 0.17 | 26 | 28 | Comparison |
| 105 | A - 9 | ExC | 0.27 | 0.17 | 26 | 29 | Comparison |
| 106 | 3 - 7 | ExC | 0.26 | 0.17 | 26 | 29 | Comparison |
| 107 | C - 3 | ExC | 0.26 | 0.17 | 26 | 30 | Comparison |
| 108 | Compound A | Exemplified Compound 11 | 0.24 | 0.10 | 24 | 39 | Comparison |
| 109 | Compound B | Exemplified Compound 11 | 0.24 | 0.10 | 24 | 40 | Comparison |
| 110 | Compound C | Exemplified Compound 11 | 0.24 | 0.10 | 25 | 38 | Comparison |
| 111 | A - 3 | Exemplified Compound 11 | 0.24 | 0.10 | 23 | 25 | Invention |
| 112 | A - 9 | Exemplified Compound 11 | 0.24 | 0.10 | 23 | 25 | Invention |
| 113 | A - 10 | Exemplified Compound 11 | 0.24 | 0.10 | 23 | 24 | Invention |
| 114 | A - 11 | Exemplified Compound 11 | 0.24 | 0.10 | 24 | 26 | Invention |
| 115 | A - 12 | Exemplified Compound 11 | 0.24 | 0.10 | 25 | 26 | Invention |

TABLE I-continued

| Sample No. | Redox Compound in 2nd and 4th Layers | Cyan Coupler in 5th Layer | Hue M-Component | Hue Y-Component | Light Fastness Condition A | Light Fastness Condition B | Note |
|---|---|---|---|---|---|---|---|
| 116 | A - 14 | Exemplified Compound 11 | 0.24 | 0.10 | 23 | 26 | Invention |
| 117 | B - 7 | Exemplified Compound 11 | 0.24 | 0.10 | 24 | 27 | Invention |
| 118 | C - 3 | Exemplified Compound 11 | 0.24 | 0.10 | 24 | 28 | Invention |
| 119 | Compound A | Exemplified Compound 21 | 0.23 | 0.10 | 24 | 40 | Comparison |
| 120 | Compound B | Exemplified Compound 21 | 0.23 | 0.10 | 24 | 38 | Comparison |
| 121 | Compound C | Exemplified Compound 21 | 0.24 | 0.10 | 25 | 38 | Comparison |
| 122 | A - 3 | Exemplified Compound 21 | 0.24 | 0.10 | 23 | 25 | Invention |
| 123 | A - 9 | Exemplified Compound 21 | 0.24 | 0.10 | 24 | 26 | Invention |
| 124 | A - 10 | Exemplified Compound 21 | 0.24 | 0.10 | 24 | 25 | Invention |
| 125 | A - 11 | Exemplified Compound 21 | 0.24 | 0.10 | 24 | 24 | Invention |
| 126 | A - 12 | Exemplified Compound 15 | 0.24 | 0.10 | 23 | 25 | Invention |
| 127 | A - 14 | Exemplified Compound 18 | 0.24 | 0.10 | 24 | 25 | Invention |
| 128 | B - 7 | Exemplified Compound 21 | 0.24 | 0.10 | 24 | 28 | Invention |
| 129 | C - 7 | Exemplified Compound 21 | 0.24 | 0.10 | 25 | 27 | Invention |

As can be seen from Table I, all the present samples using the present cyan couplers and the present redox compounds were very slight in both Y-component and M-component, that is, excellent in hue; and displayed high fastness to light under both conditions, namely under high and low humidities. In addition, the difference between the light fastness under the high humidity condition and that under the low humidity condition was slight in every present sample (that is to say, the humidity dependence of light fastness was slight in every present sample). On the other hand, the samples using couplers other than the present ones were inferior in hue to the present samples, and the samples using redox compounds other than the present ones were decidedly inferior in light fastness, particularly under the high humidity condition, when compared to the present samples.

In accordance with the present invention, color photographs which are excellent in color reproduction and have color images fast to light under both high and low humidity conditions can be obtained by the combined use of a cyan coupler specified herein and a redox compound specified herein.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having on a support at least one cyan coupler represented by the following general formula (IIIa) and at least one compound which has a molecular weight of at least 350 selected from a group consisting of the compounds represented by the following general formula (A), the compounds represented by the following general formula (B) and the compounds represented by the following general formula (C);

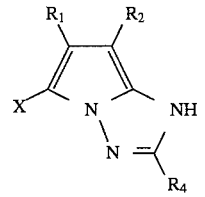

(IIIa)

wherein $R_1$ and $R_2$ each represent an electron-withdrawing group having a Hammett's substituent constant $\sigma_p$ of at least 0.2, provided that the sum of the $\sigma_p$ values of $R_1$ and $R_2$ is at least 0.65; $R_4$ represents a hydrogen atom or a substituent group; and X represents a hydrogen atom or a group capable of splitting off by the coupling reaction with the oxidation product of an aromatic primary amine color developing agent; or $R_1$, $R_2$, $R_4$ or X may be a divalent group via which the cyan coupler can form a dimer or higher polymer or combine with a high molecular chain to form a homo- or copolymer;

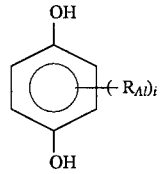

(A)

wherein $R_{A1}$ represents a monovalent group; and i represents an integer of 1 to 4, and the $R_{A1}$'s when i=2 to 4 may be the same or different;

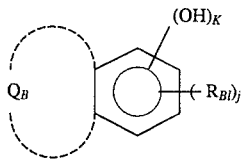

(B)

wherein $R_{B1}$ represents a monovalent group; j represents an integer of 1 to 6, and the $R_{B1}$'s when j=2 to 6 may be the same or different; k represents 2 or 3, and the two —OH groups in the case of k=2 are situated in a position ortho or meta to each other, while the three —OH groups in the case of k=3 are situated in a position adjacent to one another; - - - $Q_B$ - - - represents that a naphthalene ring may form together with the benzene ring;

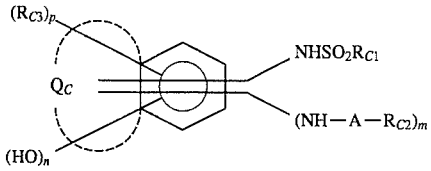

(C)

wherein A represents —CO— or —$SO_2$—; $R_{C1}$ and $R_{C2}$ each represent an alkyl group, an aryl group, a heterocyclyl group or an amino group; $R_{C3}$ represents a monovalent group; m represents an integer of 0 to 2, and the two (—NH—A—$R_{C2}$)'s in the case of m=2 may be the same or different; n represents an integer of 0 to 2, provided that the sum of m and n is 1 or 2; at least either the moiety —NH—A—$R_{C2}$ or —OH group is situated in the position ortho or para to —$NHSO_2R_{C1}$; p represents an integer of 0 to 6, and the $R_{C3}$'s in the case of p=2 to 6 may be the same or different; - - - $Q_C$ - - - represent that a naphthalene ring may form together with the benzene ring;

wherein said compound of general formula (A), (B), or (C) is contained in a light-insensitive layer provided on the support.

2. The material as claimed in claim 1, wherein said cyan coupler is contained in a red-sensitive silver halide emulsion layer provided on the support.

3. The material as claimed in claim 1, wherein the total content of the cyan coupler of general formula (IIIa) in the silver halide emulsion layer ranges from $1\times10^{-3}$ to 1 mole per mole of silver halide.

4. The material as claimed in claim 1, wherein the electron-withdrawing group represented by $R_1$, $R_2$ and $R_3$ each has the $\sigma_p$ value ranging from 0.20 to 1.0.

5. The material as claimed in claim 1, wherein the electron-withdrawing group represented by $R_1$, $R_2$ and $R_3$ each has the $\sigma_p$ value of at least 0.35.

6. The material as claimed in claim 1, wherein $R_1$ is a cyano group a trifluoromethyl group, a straight or branched unsubstituted alkoxycarbonyl group, an alkoxycarbonyl group substituted with a carbamoyl group, an ether linkage-containing alkoxycarbonyl group, an unsubstituted aryloxycarbonyl group or an alkyl- or alkoxy-substituted aryloxycarbonyl group.

7. The material as claimed in claim 1, wherein said compound of general formula (A), (B) or (C) is used in an amount of $1\times10^{-3}$ to 1 mole, per mole of said cyan coupler.

8. The material as claimed in claim 7, wherein said compound is selected from those represented by general formula (A).

9. The material as in claim 7, wherein said compound of general formula (A), (B), or (C) is used in an amount of $1\times10^{-2}$ to $1\times10^{-1}$ mole, per mole of said cyan coupler.

10. The material as claimed in claim 1, wherein the $R_{A1}$ in general formula (A) is a monovalent group selected from the group consisting of a halogen atom, an aliphatic group, an aromatic group, an alkylthio group, an arylthio group, a carbamoyl group, a cyano group, a formyl group, an aryloxy group, an alkoxy group, an acyloxy group, a carboxyl group or a salt thereof, a sulfo group or a salt thereof, an alkoxycarbonyl group, a cycloalkoxycarbonyl group, an aryloxycarbonyl group, —$COR_{A2}$, —$SO_2R_{A3}$, —$CONHR_{A4}$, and —$NHCOR_{A5}$, wherein $R_{A2}$, $R_{A3}$, $R_{A4}$, and $R_{A5}$ each represent an aliphatic group, an aromatic group or a heterocyclic group.

11. The material as claimed in claim 1, wherein the $R_{B1}$ in general formula (B) is a monovalent group selected from the group consisting of a halogen atom, an aliphatic group, cycloalkyl group, an aromatic group, an alkylthio group, a carbamoyl group, a cyano group, a formyl group, an aryloxy group, an acyloxy group, a carboxyl group or a salt thereof, a sulfo group or a salt thereof, an alkoxycarbonyl group, a cycloalkoxycarbonyl group, an aryloxycarbonyl group, —$COR_{B2}$, —$SO_2R_{B3}$, —$CONHR_{B4}$, and —$NHCOR_{B5}$, wherein $R_{B2}$, $R_{B3}$, $R_{B4}$, and $R_{B5}$ each represent an aliphatic group, an aromatic group or a heterocyclic group.

12. The material as claimed in claim 1, wherein the $R_{C3}$ in general formula (C) is a monovalent group selected from the group consisting of a halogen atom, an aliphatic group, a cycloalkyl group, an aromatic group, alkylthio group, a carbamoyl group, a cyano group, a formyl group, an aryloxy group, an acyloxy group, a carboxyl group or a salt thereof, a sulfo group or a salt thereof, an alkoxycarbonyl group, a cycloalkoxycarbonyl group, an aryloxycarbonyl group, —$COR_{B2}$, —$SO_2R_{B3}$, —$CONHR_{B4}$, and —$NHCOR_{B5}$, wherein $R_{B2}$, $R_{B3}$, $R_{B4}$, and $R_{B5}$ each represent an aliphatic group, an aromatic group or a heterocyclic group.

13. The material as claimed in claim 1, wherein said compound of general formula (A), (B) or (C) is present in a color stain-inhibiting layer provided on the support in the form of fine oil drops prepared by dissolving said compound in a high boiling organic solvent and dispersing the resulting solution through emulsification.

14. The material as claimed in claim 13, wherein said high boiling organic solvent has a dielectric constant of at least 3.5.

15. The material as claimed in claim 14, wherein said high boiling organic solvent has a dielectric constant of at least 5.0.

16. The material as claimed in claim 14, wherein said high boiling organic solvent is selected from the group consisting of phthalic acid esters, phosphoric acid esters, organic acid amides, and ketones.

17. The material as claimed in claim 1, wherein at least one light-sensitive layer provided on the support comprises a substantially iodide-free silver chloride emulsion or a substantially iodide-free silver chlorobromide emulsion having a chloride content of at least 95 mole %.

* * * * *